US011798569B2

(12) United States Patent
Kim et al.

(10) Patent No.: US 11,798,569 B2
(45) Date of Patent: Oct. 24, 2023

(54) FLEXIBLE RENDERING OF AUDIO DATA

(71) Applicant: QUALCOMM Incorporated, San Diego, CA (US)

(72) Inventors: Moo Young Kim, San Diego, CA (US); Nils Günther Peters, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 269 days.

(21) Appl. No.: 16/582,910

(22) Filed: Sep. 25, 2019

(65) Prior Publication Data

US 2020/0105282 A1 Apr. 2, 2020

Related U.S. Application Data

(60) Provisional application No. 62/740,260, filed on Oct. 2, 2018.

(51) Int. Cl.
*G10L 19/008* (2013.01)
*G10L 19/02* (2013.01)
(Continued)

(52) U.S. Cl.
CPC ..... *G10L 19/0208* (2013.01); *G10L 19/008* (2013.01); *H04R 5/04* (2013.01); *G10L 2019/0001* (2013.01)

(58) Field of Classification Search
CPC ..... G10L 19/0208; G10L 19/008
See application file for complete search history.

(56) References Cited

U.S. PATENT DOCUMENTS

2011/0249821 A1 10/2011 Jaillet et al.
2014/0025386 A1 1/2014 Xiang et al.
(Continued)

FOREIGN PATENT DOCUMENTS

CN 107071686 A 8/2017
TW 201436587 A 9/2014
(Continued)

OTHER PUBLICATIONS

International Search Report and Written Opinion—PCT/US2019/053237—ISA/EPO—dated Dec. 10, 2019, 12 pgs.
(Continued)

*Primary Examiner* — Thomas H Maung
(74) *Attorney, Agent, or Firm* — QUALCOMM Incorporated

(57) ABSTRACT

In general, techniques are described for obtaining audio rendering information from a bitstream. A method of rendering audio data includes receiving, at an interface of a device, an encoded audio bitstream, storing, to a memory of the device, encoded audio data of the encoded audio bitstream, parsing, by one or more processors of the device, a portion of the encoded audio data stored to the memory to select a renderer for the encoded audio data, the selected renderer comprising one of an object-based renderer or an ambisonic renderer, rendering, by the one or more processors of the device, the encoded audio data using the selected renderer to generate one or more rendered speaker feeds, and outputting, by one or more loudspeakers of the device, the one or more rendered speaker feeds.

26 Claims, 9 Drawing Sheets

(51) Int. Cl.
*H04R 5/04* (2006.01)
*G10L 19/00* (2013.01)

(56) References Cited

U.S. PATENT DOCUMENTS

| | | | | |
|---|---|---|---|---|
| 2014/0219455 | A1 | 8/2014 | Peters et al. | |
| 2015/0243292 | A1 | 8/2015 | Morrell et al. | |
| 2015/0264483 | A1 | 9/2015 | Morrell et al. | |
| 2015/0341736 | A1 | 11/2015 | Peters et al. | |
| 2016/0080886 | A1* | 3/2016 | De Bruijn | H04R 5/02 381/17 |
| 2017/0200452 | A1 | 7/2017 | Peters et al. | |
| 2017/0347219 | A1* | 11/2017 | McCauley | G06F 3/04815 |
| 2017/0366913 | A1 | 12/2017 | Stein et al. | |
| 2018/0091917 | A1* | 3/2018 | Chon | H04S 7/303 |
| 2019/0007781 | A1 | 1/2019 | Peters et al. | |

FOREIGN PATENT DOCUMENTS

| | | | |
|---|---|---|---|
| TW | 201810249 | A | 3/2018 |
| WO | 2014184353 | A1 | 11/2014 |
| WO | 2014194099 | A1 | 12/2014 |
| WO | 2015184307 | A1 | 12/2015 |

OTHER PUBLICATIONS

Audio, "Call for Proposals for 3D Audio," International Organisation for Standardisation Organisation Internationale De Normalisation ISO/IEC JTC1/SC29/WG11 Coding of Moving Pictures and Audio, ISO/IEC JTC1/SC29/WG11/N13411, Geneva, Jan. 2013, pp. 1-20.

ETSI TS 103 589 V1.1.1, "Higher Order Ambisonics (HOA) Transport Format", Jun. 2018, 33 pages.

Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.

Hollerweger F., "An Introduction to Higher Order Ambisonic," Oct. 2008, pp. 13, Accessed online [Jul. 8, 2013] at <URL: flo.mur.at/writings/HOA-intro.pdf>.

"Information technology—High Efficiency Coding and Media Delivery in Heterogeneous Environments—Part 3: 3D Audio," ISO/IEC JTC 1/SC 29/WG11, ISO/IEC 23008-3, 201x(E), Oct. 12, 2016, 797 Pages.

"Information technology—High efficiency coding and media delivery in heterogeneous environments—Part 3: Part 3: 3D Audio, Amendment 3: MPEG-H 3D Audio Phase 2," ISO/IEC JTC 1/SC 29N, ISO/IEC 23008-3:2015/PDAM 3, Jul. 25, 2015, 208 pp.

"Information technology—High efficiency coding and media delivery in heterogeneous environments—Part 3: 3D Audio," ISO/IEC JTC 1/SC 29N, Apr. 4, 2014, 337 pp.

ISO/IEC DIS 23008-3 Information Technology—High Efficiency coding and media delivery in heterogeneous environments—Part 3: 3D audio, Jul. 25, 2014 (Jul. 25, 2014), XP055205625, Retrieved from the Internet URL: http://mpeg.chiariglione.org/standards/mpeg-h/3d-audio/dis-mpeg-h-3d-audio [retrieved on Jul. 30, 2015], 433 pages.

Poletti M., "Three-Dimensional Surround Sound Systems Based on Spherical Harmonics," The Journal of the Audio Engineering Society, vol. 53, No. 11, Nov. 2005, pp. 1004-1025.

Schonefeld V., "Spherical Harmonics," Jul. 1, 2005, XP002599101, 25 Pages, Accessed online [Jul. 9, 2013] at URL:http://videoarch1.s-inf.de/~volker/prosem_paper.pdf.

Sen D., et al., "RM1-HOA Working Draft Text", 107. MPEG Meeting; Jan. 13, 2014-Jan. 17, 2014; San Jose; (Motion Picture Expert Group or ISO/IEC JTC1/SC29/WG11), No. m31827, Jan. 11, 2014 (Jan. 11, 2014), 83 Pages, XP030060280.

Sen D., et al., "Technical Description of the Qualcomm's HoA Coding Technology for Phase II", 109. MPEG Meeting; Jul. 7, 2014-Jul. 11, 2014; Sapporo; (Motion Picture Expert Group or ISO/IEC JTC1/SC29/WG11), No. m34104, Jul. 2, 2014 (Jul. 2, 2014), XP030062477, figure 1.

International Preliminary Report on Patentability—PCT/US2019/053237, The International Bureau of WIPO—Geneva, Switzerland, dated Apr. 15, 2021 7 Pages.

European Search Report—EP22198798—Search Authority—Munich—dated Feb. 7, 2023 8 Pages.

Taiwan Search Report—108134887—TIPO—dated Apr. 17, 2023 1 Page.

* cited by examiner

FLEXIBLE RENDERING OF AUDIO DATA

This application claims the benefit of U.S. Provisional Application Ser. No. 62/740,260, entitled "FLEXIBLE RENDERING OF AUDIO DATA," filed Oct. 2, 2018, the entire contents of which are hereby incorporated by reference as if set forth in its entirety herein.

TECHNICAL FIELD

This disclosure relates to rendering information and, more specifically, rendering information for audio data.

BACKGROUND

During production of audio content, the sound engineer may render the audio content using a specific renderer in an attempt to tailor the audio content for target configurations of speakers used to reproduce the audio content. In other words, the sound engineer may render the audio content and playback the rendered audio content using speakers arranged in the targeted configuration. The sound engineer may then remix various aspects of the audio content, render the remixed audio content and again playback the rendered, remixed audio content using the speakers arranged in the targeted configuration. The sound engineer may iterate in this manner until a certain artistic intent is provided by the audio content. In this way, the sound engineer may produce audio content that provides a certain artistic intent or that otherwise provides a certain sound field during playback (e.g., to accompany video content played along with the audio content).

SUMMARY

In general, techniques are described for specifying audio rendering information in a bitstream representative of audio data. In various examples, the techniques of this disclosure provide for ways by which to signal audio renderer-selection information used during audio content production to a playback device. The playback device may, in turn use the signaled audio renderer-selection information to select one or more renderers, and use the selected renderer(s) to render the audio content. Providing the rendering information in this manner enables the playback device to render the audio content in a manner intended by the sound engineer, and thereby potentially ensure appropriate playback of the audio content such that the artistic intent is preserved and understood by a listener.

In other words, the rendering information used during rendering by the sound engineer is provided in accordance with the techniques described in this disclosure so that the audio playback device may utilize the rendering information to render the audio content in a manner intended by the sound engineer, thereby ensuring a more consistent experience during both production and playback of the audio content in comparison to systems that do not provide this audio rendering information. Moreover, the techniques of this disclosure enable the playback to leverage both object-based and ambisonic representations of a soundfield, in preserving the artistic intent of the soundfield. That is, a content creator device or content producer device may implement the techniques of this disclosure to signal renderer-identifying information to the playback device, thereby enabling the playback to device to select the appropriate renderer for a pertinent portion of the soundfield-representative audio data.

In one aspect, this disclosure is directed to a device configured to encode audio data. The device includes a memory, and one or more processors in communication with the memory. The memory is configured to store audio data. The one or more processors are configured to encode the audio data to form encoded audio data, to select a renderer associated with the encoded audio data, the selected renderer comprising one of an object-based renderer or an ambisonics renderer, and to generate an encoded audio bitstream comprising the encoded audio data and data indicative of the selected renderer. In some implementations, the device includes one or more microphones in communication with the memory. In these implementations, the one or more microphones are configured to receive the audio data. In some implementations, the device includes and interface in communication with the one or more processors. In these implementations, the interface is configured to signal the encoded audio bitstream.

In another aspect, this disclosure is directed to a method of encoding audio data. The method includes storing audio data to a memory of a device, and encoding, by one or more processors of the device, the audio data to form encoded audio data. The method further includes selecting, by the one or more processors of the device, a renderer associated with the encoded audio data, the selected renderer comprising one of an object-based renderer or an ambisonic renderer. The method further includes generating, by the one or more processors of the device, an encoded audio bitstream comprising the encoded audio data and data indicative of the selected renderer. In some non-limiting examples, the method further includes signaling, by an interface of the device, the encoded audio bitstream. In some non-limiting examples, the method further includes receiving, by one or more microphones of the device, the audio data.

In another aspect, this disclosure is directed to an apparatus for encoding audio data. The apparatus includes means for storing audio data, and means for encoding the audio data to form encoded audio data. The apparatus further includes means for selecting a renderer associated with the encoded audio data, the selected renderer comprising one of an object-based renderer or an ambisonic renderer. The apparatus further includes means for generating an encoded audio bitstream comprising the encoded audio data and data indicative of the selected renderer.

In another aspect, this disclosure is directed to a non-transitory computer-readable storage medium encoded with instructions. The instructions, when executed, cause one or more processors of a device for encoding audio data to store audio data to a memory of the device, to encode the audio data to form encoded audio data, to select a renderer associated with the encoded audio data, the selected renderer comprising one of an object-based renderer or an ambisonic renderer, and to generate an encoded audio bitstream comprising the encoded audio data and data indicative of the selected renderer.

In another aspect, this disclosure is directed to a device configured to render audio data. The device includes a memory and one or more processors in communication with the memory. The memory is configured to store encoded audio data of an encoded audio bitstream. The one or more processors are configured to parse a portion of the encoded audio data stored to the memory to select a renderer for the encoded audio data, the selected renderer comprising one of an object-based renderer or an ambisonic renderer, and to render the encoded audio data using the selected renderer to generate one or more rendered speaker feeds. In some implementations, the device includes an interface in communication with the memory. In these implementations, the interface is configured to receive the encoded audio bitstream. In some implementations, the device includes one or more loudspeakers in communication with the one or more processors. In these implementations, the one or more loudspeakers are configured to output the one or more rendered speaker feeds.

In another aspect, this disclosure is directed to a method of rendering audio data. The method includes storing, to a memory of the device, encoded audio data of an encoded audio bitstream. The method further includes parsing, by one or more processors of the device, a portion of the encoded audio data stored to the memory to select a renderer for the encoded audio data, the selected renderer comprising one of an object-based renderer or an ambisonic renderer. The method further includes rendering, by the one or more processors of the device, the encoded audio data using the selected renderer to generate one or more rendered speaker feeds. In some non-limiting examples, the method further includes receiving, at an interface of a device, an encoded audio bitstream. In some non-limiting examples, the method further includes outputting, by one or more loudspeakers of the device, the one or more rendered speaker feeds.

In another aspect, this disclosure is directed to an apparatus configured to render audio data. The apparatus includes means for storing encoded audio data of an encoded audio bitstream and means for parsing a portion of the stored encoded audio data to select a renderer for the encoded audio data, the selected renderer comprising one of an object-based renderer or an ambisonic renderer. The apparatus further includes means for rendering the stored encoded audio data using the selected renderer to generate one or more rendered speaker feeds. In some non-limiting examples, the apparatus further includes means for receiving the encoded audio bitstream. In some non-limiting examples, the apparatus further includes means for outputting the one or more rendered speaker feeds.

In another aspect, this disclosure is directed to a non-transitory computer-readable storage medium encoded with instructions. The instructions, when executed, cause one or more processors of a device for rendering audio data to store, to a memory of the device, encoded audio data of an encoded audio bitstream, to parse a portion of the encoded audio data stored to the memory to select a renderer for the encoded audio data, the selected renderer comprising one of an object-based renderer or an ambisonic renderer, and to render the encoded audio data using the selected renderer to generate one or more rendered speaker feeds.

The details of one or more aspects of the techniques are set forth in the accompanying drawings and the description below. Other features, objects, and advantages of the techniques will be apparent from the description and drawings, and from the claims.

DETAILED DESCRIPTION

Figure 1:
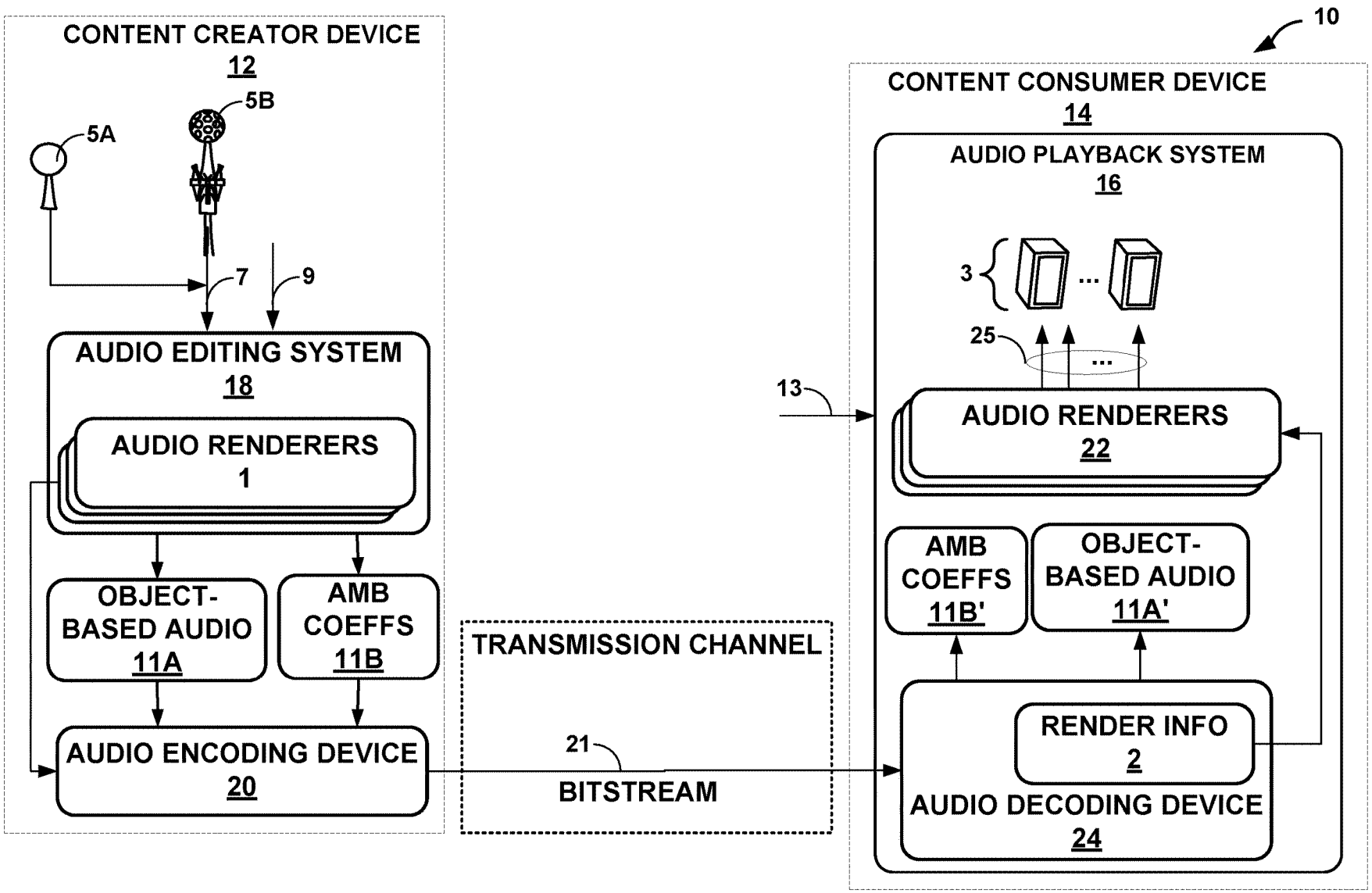
FIG. 1 is a diagram illustrating a system that may perform various aspects of the techniques described in this disclosure.

There are a number of different ways to represent a soundfield. Example formats include channel-based audio formats, object-based audio formats, and scene-based audio formats. Channel-based audio formats refer to the 5.1 surround sound format, 7.1 surround sound formats, 22.2 surround sound formats, or any other channel-based format that localizes audio channels to particular locations around the listener in order to recreate a soundfield.

Object-based audio formats may refer to formats in which audio objects, often encoded using pulse-code modulation (PCM) and referred to as PCM audio objects, are specified in order to represent the soundfield. Such audio objects may include metadata identifying a location of the audio object relative to a listener or other point of reference in the soundfield, such that the audio object may be rendered to one or more speaker channels for playback in an effort to recreate the soundfield. The techniques described in this disclosure may apply to any of the foregoing formats, including scene-based audio formats, channel-based audio formats, object-based audio formats, or any combination thereof.

Scene-based audio formats may include a hierarchical set of elements that define the soundfield in three dimensions. One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here $$k = \frac{\omega}{c},$$

c is the speed of sound (~343 m/s), $\{r_r, \theta_r, \varphi_r\}$ is a point of reference (or observation point), $j_n(\cdot)$ is the spherical Bessel function of order n, and $Y_n^m(\theta_r, \varphi_r)$ are the spherical harmonic basis functions (which may also be referred to as a spherical basis function) of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

The SHC $A_n^m(k)$ can either be physically acquired (e.g., recorded) by various microphone array configurations or, alternatively, they can be derived from channel-based or object-based descriptions of the soundfield. The SHC (which also may be referred to as ambisonic coefficients) represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be physically acquired from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

The following equation may illustrate how the SHCs may be derived from an object-based description. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s, \varphi_s),$$

where i is, $\sqrt{-1}$, $h_n^{(2)}(\cdot)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the pulse code modulated—PCM—stream) may enable conversion of each PCM object and the corresponding location into the SHC $A_n^m(k)$. Further, it can be shown (since the above is a linear and orthogonal decomposition) that the $A_n^m(k)$ coefficients for each object are additive. In this manner, a number of PCM objects can be represented by the $A_n^m(k)$ coefficients (e.g., as a sum of the coefficient vectors for the individual objects). The coefficients may contain information about the soundfield (the pressure as a function of 3D coordinates), and the above represents the transformation from individual objects to a representation of the overall soundfield, in the vicinity of the observation point $\{r_r, \theta_r, \varphi_r\}$.

FIG. 1 is a diagram illustrating a system 10 that may perform various aspects of the techniques described in this disclosure. As shown in the example of FIG. 1, the system 10 includes a content creator device 12 and a content consumer device 14. While described in the context of the content creator device 12 and the content consumer device 14, the techniques may be implemented in any context in which SHCs (which may also be referred to as ambisonic coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The content creator device 12 may be operated by a movie studio or other entity that may generate multi-channel audio content for consumption by operators of content consumer devices, such as the content consumer device 14. In some examples, the content creator device 12 may be operated by an individual user who would like to compress ambisonic coefficients 11B ("AMB COEFFS 11B").

The ambisonic coefficients 11B may take a number of different forms. For instance, the microphone 5B may use a coding scheme for ambisonic representations of a soundfield, referred to as Mixed Order Ambisonics (MOA) as discussed in more detail in U.S. application Ser. No. 15/672,058, entitled "MIXED-ORDER AMBISONICS (MOA) AUDIO DATA FO COMPUTER-MEDIATED REALITY SYSTEMS," filed Aug. 8, 2017, and published as U.S. patent publication no. 20190007781 on Jan. 3, 2019.

To generate a particular MOA representation of the soundfield, the microphone 5B may generate a partial subset of the full set of ambisonic coefficients. For instance, each MOA representation generated by the microphone 5B may provide precision with respect to some areas of the soundfield, but less precision in other areas. In one example, an MOA representation of the soundfield may include eight (8) uncompressed ambisonic coefficients, while the third order ambisonic representation of the same soundfield may include sixteen (16) uncompressed ambisonic coefficients. As such, each MOA representation of the soundfield that is generated as a partial subset of the ambisonic coefficients may be less storage-intensive and less bandwidth intensive (if and when transmitted as part of the bitstream 21 over the illustrated transmission channel) than the corresponding third order ambisonic representation of the same soundfield generated from the ambisonic coefficients.

Another example form of ambisonic coefficients includes a first-order ambisonic (FOA) representations in which all of the ambisonic coefficients associated with a first order spherical basis function and a zero order spherical basis function are used to represent the soundfield. In other words, rather than represent the soundfield using a partial, non-zero subset of the ambisonic coefficients, the microphone 5B may represent the soundfield using all of the ambisonic coefficients for a given order N, resulting in a total of ambi sonic coefficients equaling $(N+1)^2$.

In this respect, the ambisonic audio data (which is another way to refer to the ambisonic coefficients in either MOA representations or full order representations, such as the first-order representation noted above) may include ambisonic coefficients associated with spherical basis functions having an order of one or less (which may be referred to as "$1^{st}$ order ambisonic audio data"), ambisonic coefficients associated with spherical basis functions having a mixed order and suborder (which may be referred to as the "MOA representation" discussed above), or ambisonic coefficients associated with spherical basis functions having an order greater than one (which is referred to above as the "full order representation").

In any event, the content creator may generate audio content (including the ambisonic coefficients in one or more of the above noted forms) in conjunction with video content. The content consumer device 14 may be operated by an individual. The content consumer device 14 may include an audio playback system 16, which may refer to any form of audio playback system capable of rendering SHC (such as the ambisonic coefficients 11B) for play back as multi-channel audio content.

The content creator device 12 includes an audio editing system 18. The content creator device 12 may obtain live recordings 7 in various formats (including directly as ambisonic coefficients, as object-based audio, etc.) and audio objects 9, which the content creator device 12 may edit using audio editing system 18. The microphone 5A and/or the microphone 5B (the "microphones 5") may capture the live recordings 7. In the example of FIG. 1, the microphone 5A represents a microphone or set of microphones that are configured or otherwise operable to capture audio data and generate object-based and/or channel-based signals representing the captured audio data. As such, the live recordings 7 may represent, in various use case scenarios, ambisonic coefficients, object-based audio data, or a combination thereof The content creator may, during the editing process, render ambisonic coefficients 11B from audio objects 9, listening to the rendered speaker feeds in an attempt to identify various aspects of the soundfield that require further editing. The content creator device 12 may then edit the ambisonic coefficients 11B (potentially indirectly through manipulation of different ones of the audio objects 9 from which the source ambisonic coefficients may be derived in the manner described above). The content creator device 12 may employ the audio editing system 18 to generate the ambisonic coefficients 11B. The audio editing system 18 represents any system capable of editing audio data and outputting the audio data as one or more source spherical harmonic coefficients.

When the editing process is complete, the content creator device 12 may generate a bitstream 21 based on the ambisonic coefficients 11B. That is, the content creator device 12 includes an audio encoding device 20 that represents a device configured to encode or otherwise compress the ambisonic coefficients 11B in accordance with various aspects of the techniques described in this disclosure to generate the bitstream 21. The audio encoding device 20 may generate the bitstream 21 for transmission, as one example, across a transmission channel, which may be a wired or wireless channel, a data storage device, or the like. In instances in which the live recordings 7 are used to produce the ambisonic coefficients 11B, a portion of the bitstream 21 may represent an encoded version of the ambisonic coefficients 11B. In instances where the live recordings 7 include an object-based audio signal, the bitstream 21 may include an encoded version of the object-based audio data 11A. In any event, the audio encoding device 20 may generate the bitstream 21 to include a primary bitstream and other side information, such as metadata, which may also be referred to herein as side channel information.

In accordance with aspects of this disclosure, the audio encoding device 20 may generate the side channel information of the bitstream 21 to include renderer-selection information pertaining to the audio renderers 1 illustrated in FIG. 1. In some examples, the audio encoding device 20 may generate the side channel information of the bitstream 21 to indicate whether an object-based renderer of the audio renderers 1 was used for content creator-side rendering of the audio data of the bitstream 21, or an ambisonic renderer of the audio renderers 1 was used for the content creator-side rendering of the audio data of the bitstream 21. In some examples, if the audio renderers 1 include more than one ambisonic renderer and/or more than one object-based renderer, the audio encoding device 20 may include additional renderer-selection information in the side channel of the bitstream 21. For instance, if the audio renderers 1 include multiple renderers that are applicable to the same type (object or ambisonic) of audio data, the audio encoding device 20 may include a renderer identifier (or "renderer ID") in the side channel information, in addition to the renderer type.

According to some example implementations of the techniques of this disclosure, the audio encoding device 20 may signal information signifying one or more of the audio renderers 1 in the bitstream 21. For instance, if the audio encoding device 20 determines that a particular one or more of the audio renderers 1 were used for content creator-side rendering of the audio data of the bitstream 21, then the audio encoding device 20 may signal one or more matrices signifying the identified audio renderer(s) 1 in the bitstream 21. In this way, according to these example implementations of this disclosure, the audio encoding device 20 may provide the data necessary to apply one or more of the audio renderers 1 directly, via the side channel information of the bitstream 21, for a decoding device to render the audio data signaled via the bitstream 21. Throughout this disclosure, implementations in which the audio encoding device 20 transmits matrix information representing any of the audio renderers 1 are referred to as "renderer transmission" implementations.

While shown in FIG. 1 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 1.

As further shown in the example of FIG. 1, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode ambisonic coefficients 11B' from the bitstream 21, where the ambisonic coefficients 11B' may be similar to the ambisonic coefficients 11B but differ due to lossy operations (e.g., quantization) and/or transmission via the transmission channel. The audio playback system 16 may, after decoding the bitstream 21 to obtain the ambisonic coefficients 11B' and render the ambisonic coefficients 11B' to output loudspeaker feeds 25. The loudspeaker feeds 25 may drive one or more speakers 3.

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (in terms of the loudspeaker geometry) to the loudspeaker geometry specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22. One or more speakers 3 may then playback the rendered loudspeaker feeds 25.

When the speakers 3 represent speakers of headphones, the audio playback system 16 may utilize one of the renderers 22 that provides for binaural rendering using head-related transfer functions (HRTF) or other functions capable of rendering to left and right speaker feeds 25 for headphone speaker playback. The terms "speakers" or "transducer" may generally refer to any speaker, including loudspeakers, headphone speakers, etc. One or more speakers 3 may then playback the rendered speaker feeds 25.

In some instances, the audio playback system 16 may select any one the of audio renderers 22 and may be configured to select the one or more of audio renderers 22 depending on the source from which the bitstream 21 is received (such as a DVD player, a Blu-ray player, a smartphone, a tablet computer, a gaming system, and a television to provide a few examples). While any one of the audio renderers 22 may be selected, often the audio renderer used when creating the content provides for a better (and possibly the best) form of rendering due to the fact that the content was created by the content creator 12 using this one of audio renderers, i.e., the audio renderer 5 in the example of FIG. 1. Selecting the one of the audio renderers 22 that is the same or at least close (in terms of rendering form) may provide for a better representation of the sound field and may result in a better surround sound experience for the content consumer 14.

In accordance with the techniques described in this disclosure, the audio encoding device 20 may generate the bitstream 21 (e.g., the side channel information thereof) to include the audio rendering information 2 ("render info 2"). The audio rendering information 2 may include a signal value identifying an audio renderer used when generating the multi-channel audio content, i.e., one or more of the audio renderers 1 in the example of FIG. 1. In some instances, the signal value includes a matrix used to render spherical harmonic coefficients to a plurality of speaker feeds.

As described above, in accordance with aspects of this disclosure, the audio encoding device 20 may include the audio rendering information 2 in the side channel information of the bitstream 21. In these examples, the audio decoding device 24 may parse the side channel information of the bitstream 21 to obtain, as part of the audio rendering information 2, an indication of whether an object-based renderer of the audio renderers 22 is to be used to render the audio data of the bitstream 21, or an ambisonic renderer of the audio renderers 22 is to be used to render the audio data of the bitstream 21. In some examples, if the audio renderers 22 include more than one ambisonic renderer and/or more than one object-based renderer, the audio decoding device 24 may obtain additional renderer-selection information as part of the audio rendering information 2 from the side channel information of the bitstream 21. For instance, if the audio renderers 22 include multiple renderers that are applicable to the same type (object or ambisonic) of audio data, the audio decoding device 24 may obtain a renderer ID as part of the audio rendering information 2 from the side channel information of the bitstream 21, in addition to obtaining the renderer type.

According to renderer transmission implementations of the techniques of this disclosure, the audio decoding device 24 may signal information signifying one or more of the audio renderers 1 in the bitstream 21. In these examples, the audio decoding device 24 may obtain one or more matrices signifying the identified audio renderer(s) 22 from the audio rendering information 2, and apply matrix multiplication using the matrix/matrices to render the object-based audio data 11A' and/or the ambisonic coefficients 11B'. In this way, according to these example implementations of this disclosure, the audio encoding device 24 may directly receive, via the bitstream 21, the data necessary to apply one or more of the audio renderers 22, to render the object-based audio data 11A' and/or the ambisonic coefficients 11B'.

In other words and as noted above, ambisonic coefficients (including so-called Higher Order Ambisonic—HOA—coefficients) may represent a way by which to describe directional information of a sound-field based on a spatial Fourier transform. Generally, the higher the ambisonics order N, the higher the spatial resolution, the larger the number of spherical harmonics (SH) coefficients (N+1)^2, and the larger the required bandwidth for transmitting and storing the data. HOA coefficients generally refer to ambisonic representation having ambisonic coefficients associated with spherical basis functions having an order greater than one.

A potential advantage of this description is the possibility to reproduce this soundfield on most any loudspeaker setup (e.g., 5.1, 7.1 22.2, etc.). The conversion from the soundfield description into M loudspeaker signals may be done via a static rendering matrix with $(N+1)^2$ inputs and M outputs. Consequently, every loudspeaker setup may require a dedicated rendering matrix. Several algorithms may exist for computing the rendering matrix for a desired loudspeaker setup, which may be optimized for certain objective or subjective measures, such as the Gerzon criteria. For irregular loudspeaker setups, algorithms may become complex due to iterative numerical optimization procedures, such as convex optimization.

To compute a rendering matrix for irregular loudspeaker layouts without waiting time, it may be beneficial to have sufficient computation resources available. Irregular loudspeaker setups may be common in domestic living room environments due to architectural constrains and aesthetic preferences. Therefore, for the best soundfield reproduction, a rendering matrix optimized for such scenario may be preferred in that it may enable reproduction of the soundfield more accurately.

Because an audio decoder usually does not require much computational resources, the device may not be able to compute an irregular rendering matrix in a consumer-friendly time. Various aspects of the techniques described in this disclosure may provide for the use a cloud-based computing approach as follows:

1. The audio decoder may send via an Internet connection the loudspeaker coordinates (and, in some instances, also SPL measurements obtained with a calibration microphone) to a server;
2. The cloud-based server may compute the rendering matrix (and possibly a few different versions, so that the customer may later choose from these different versions); and
3. The server may then send the rendering matrix (or the different versions) back to the audio decoder via the Internet connection.

This approach may allow the manufacturer to keep manufacturing costs of an audio decoder low (because a powerful processor may not be needed to compute these irregular rendering matrices), while also facilitating a more optimal audio reproduction in comparison to rendering matrices usually designed for regular speaker configurations or geometries. The algorithm for computing the rendering matrix may also be optimized after an audio decoder has shipped, potentially reducing the costs for hardware revisions or even recalls. The techniques may also, in some instances, gather a lot of information about different loudspeaker setups of consumer products which may be beneficial for future product developments.

Again, in some instances, the system shown in FIG. 1 may not incorporate signaling of the audio rendering information 2 in the bitstream 21 as described above, but instead, may use signaling of this audio rendering information 2 as metadata separate from the bitstream 21. Alternatively or in conjunction with that described above, the system shown in FIG. 1 may signal a portion of the audio rendering information 2 in the bitstream 21 as described above and signal a portion of this audio rendering information 2 as metadata separate from the bitstream 21. In some examples, the audio encoding device 20 may output this metadata, which may then be uploaded to a server or other device. The audio decoding device 24 may then download or otherwise retrieve this metadata, which is then used to augment the audio rendering information extracted from the bitstream 21 by the audio decoding device 24. The bitstream 21 formed in accordance with the rendering information aspects of the techniques are described below.

Figure 2:
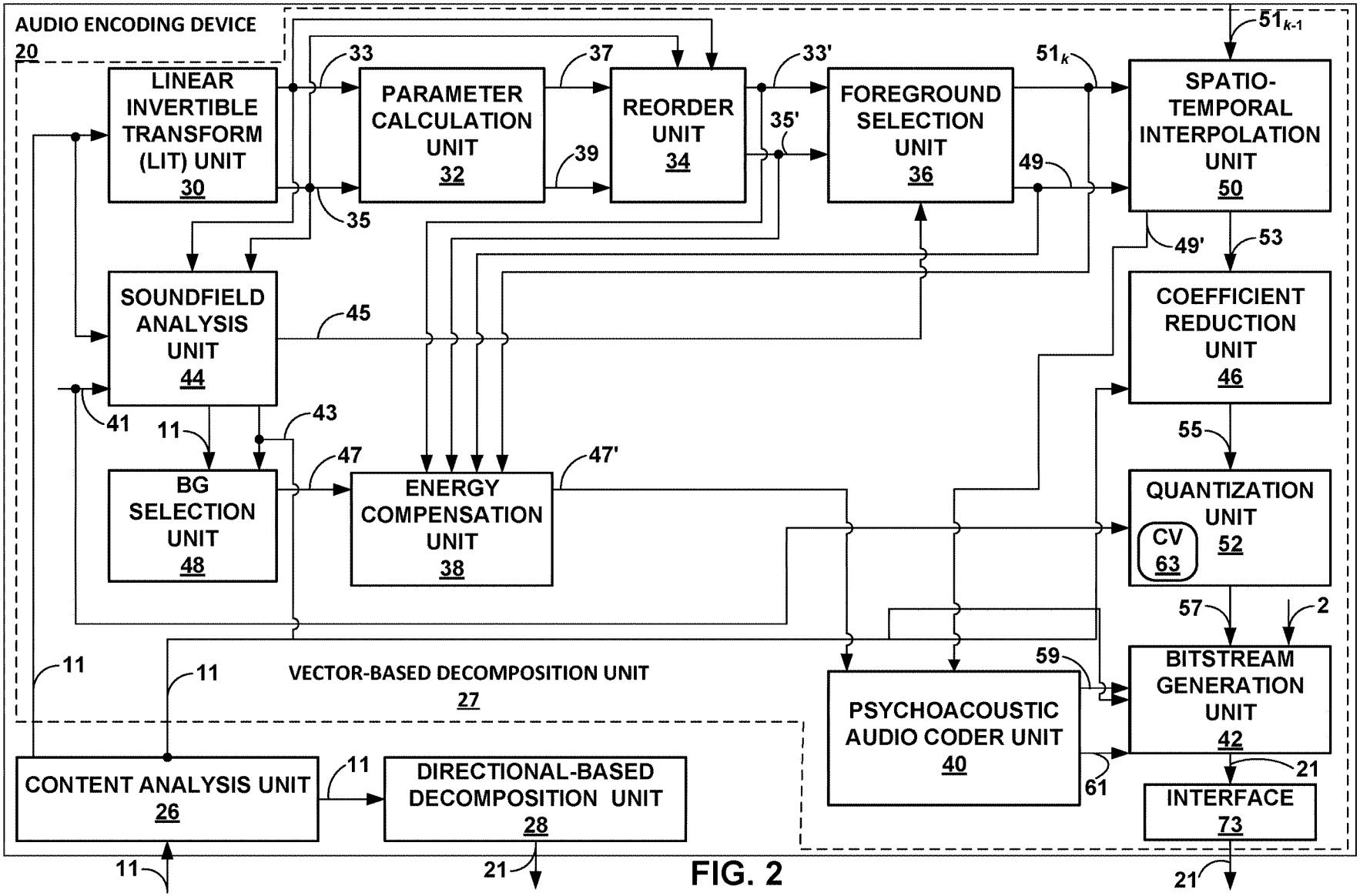
FIG. 2 is a block diagram illustrating, in more detail, one example of the audio encoding device shown in the example of FIG. 1 that may perform various aspects of the techniques described in this disclosure.

FIG. 2 is a block diagram illustrating, in more detail, one example of the audio encoding device 20 shown in the example of FIG. 1 that may perform various aspects of the techniques described in this disclosure. The audio encoding device 20 includes a content analysis unit 26, a vector-based decomposition unit 27 and a directional-based decomposition unit 28. Although described briefly below, more information regarding the audio encoding device 20 and the various aspects of compressing or otherwise encoding ambisonic coefficients is available in International Patent Application Publication No. WO 2014/194099, entitled "INTERPOLATION FOR DECOMPOSED REPRESENTATIONS OF A SOUND FIELD," filed 29 May, 2014.

The audio encoding device 20 is illustrated in FIG. 2 as including various units, each of which is further described below with respect to particular functionalities of the audio encoding device 20 as a whole. The various units of the audio encoding device 20 may be implemented using processor hardware, such as one or more processors. That is, a given processor of the audio encoding device 20 may implement the functionalities described below with respect one of the illustrated units, or of multiple units of the illustrated units. The processor(s) of the audio encoding device 20 may include processing circuitry (e.g. fixed function circuitry, programmable processing circuitry, or any combination thereof), application specific integrated circuits (ASICs), such as one or more hardware ASICs, digital signal processors (DSPs), general purpose microprocessors, field programmable logic arrays (FPGAs), or other equivalent integrated circuitry or discrete logic circuitry. The processor(s) of the audio encoding device 20 may be configured to execute, using the processing hardware thereof, software to perform the functionalities described below with respect to the illustrated units.

The content analysis unit 26 represents a unit configured to analyze the content of the object-based audio data 11A and/or ambisonic coefficients 11B (collectively, the "audio data 11") to identify whether the audio data 11 represents content generated from a live recording or an audio object or both. The content analysis unit 26 may determine whether the audio data 11 were generated from a recording of an actual soundfield or from an artificial audio object. In some instances, when the audio data 11 (e.g., the framed ambisonic coefficients 11B) were generated from a recording, the content analysis unit 26 passes the framed ambisonic coefficients 11B to the vector-based decomposition unit 27.

In some instances, when the audio data 11 (e.g., the framed ambisonic coefficients 11B) were generated from a synthetic audio object, the content analysis unit 26 passes the ambisonic coefficients 11B to the directional-based synthesis unit 28. The directional-based synthesis unit 28 may represent a unit configured to perform a directional-based synthesis of the ambisonic coefficients 11B to generate a directional-based bitstream 21. In examples where the audio data 11 includes the object-based audio data 11A, the content analysis unit 26 passes the object-based audio data 11A to the bitstream generation unit 42.

As shown in the example of FIG. 2, the vector-based decomposition unit 27 may include a linear invertible transform (LIT) unit 30, a parameter calculation unit 32, a reorder unit 34, a foreground selection unit 36, an energy compensation unit 38, a psychoacoustic audio coder unit 40, a bitstream generation unit 42, a soundfield analysis unit 44, a coefficient reduction unit 46, a background (BG) selection unit 48, a spatio-temporal interpolation unit 50, and a quantization unit 52.

The linear invertible transform (LIT) unit 30 receives the ambisonic coefficients 11B in the form of ambisonic channels, each channel representative of a block or frame of a coefficient associated with a given order, sub-order of the spherical basis functions (which may be denoted as HOA[k], where k may denote the current frame or block of samples). The matrix of ambisonic coefficients 11B may have dimensions D:M×$(N+1)^2$.

The LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set." An alternative transformation may comprise a principal component analysis, which is often referred to as "PCA." Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multichannel audio data.

Figure 3:
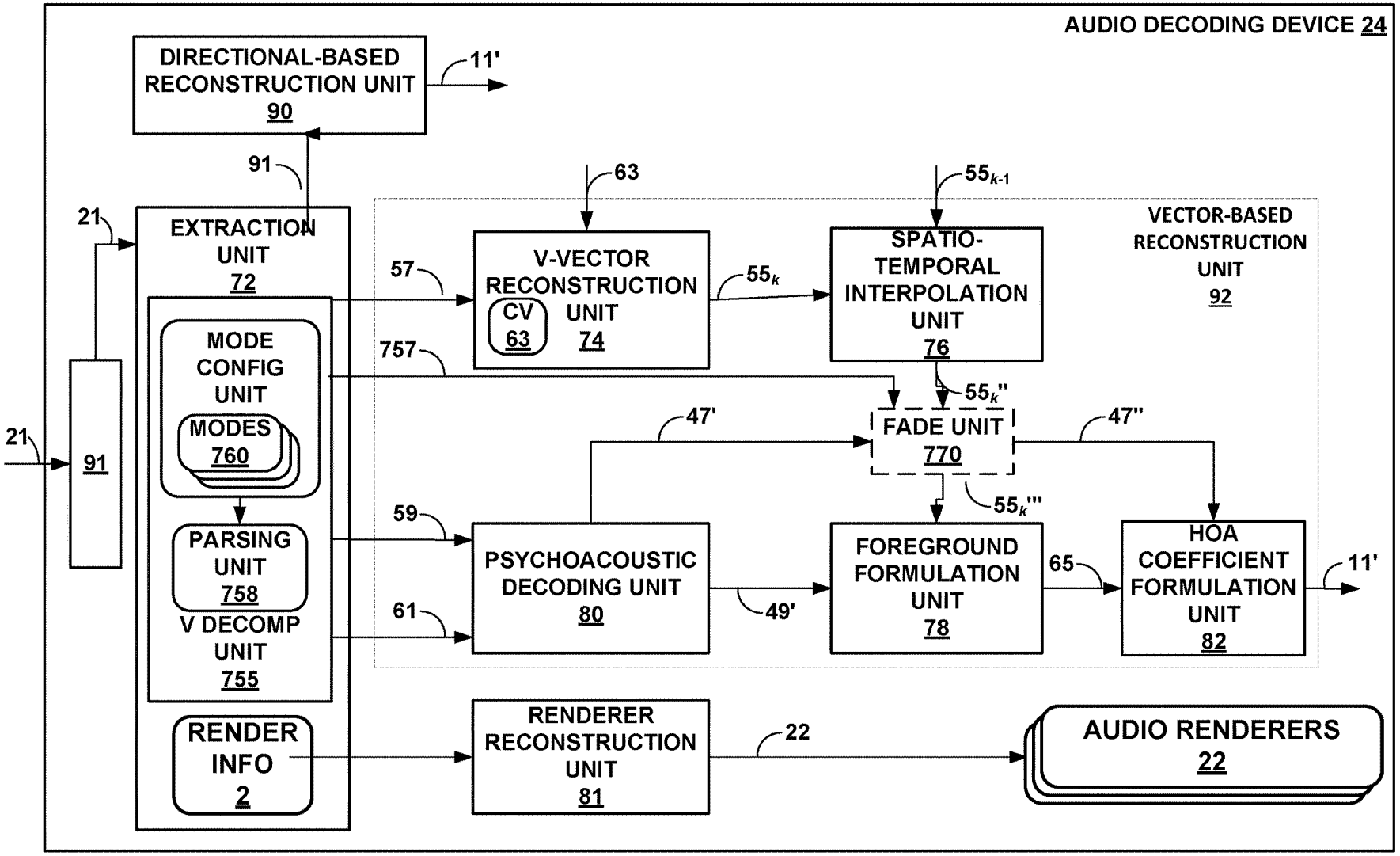
FIG. 3 is a block diagram illustrating the audio decoding device of FIG. 1 in more detail.

In any event, assuming the LIT unit 30 performs a singular value decomposition (which, again, may be referred to as "SVD") for purposes of example, the LIT unit 30 may transform the ambisonic coefficients 11B into two or more sets of transformed ambisonic coefficients. The "sets" of transformed ambisonic coefficients may include vectors of transformed ambisonic coefficients. In the example of FIG. 3, the LIT unit 30 may perform the SVD with respect to the ambisonic coefficients 11B to generate a so-called V matrix, an S matrix, and a U matrix. SVD, in linear algebra, may represent a factorization of a y-by-z real or complex matrix X (where X may represent multi-channel audio data, such as the ambisonic coefficients 11B) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the ambisonic coefficients 11B comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to ambisonic coefficients 11B having complex coefficients, where the output of the SVD is the V* matrix. Accordingly, the techniques should not be limited in this respect to only provide for application of SVD to generate a V matrix, but may include application of SVD to ambisonic coefficients 11B having complex components to generate a V* matrix.

In this way, the LIT unit 30 may perform SVD with respect to the ambisonic coefficients 11B to output US[k] vectors 33 (which may represent a combined version of the S vectors and the U vectors) having dimensions D: M×$(N+1)^2$, and V[k] vectors 35 having dimensions D: $(N+1)^2$×$(N+1)^2$. Individual vector elements in the US[k] matrix may also be termed $X_{PS}(k)$ while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$). The individual elements of each of $v^{(i)}(k)$ vectors may represent an ambisonic coefficient describing the shape (including width) and position of the soundfield for an associated audio object.

Both the vectors in the U matrix and the V matrix are normalized such that their root-mean-square energies are equal to unity. The energy of the audio signals in U is thus represented by the diagonal elements in S. Multiplying U and S to form US[k] (with individual vector elements $X_{PS}(k)$), thus represent the audio signal with energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document.

Although described as being performed directly with respect to the ambisonic coefficients 11B, the LIT unit 30 may apply the linear invertible transform to derivatives of the ambisonic coefficients 11B. For example, the LIT unit 30 may apply SVD with respect to a power spectral density matrix derived from the ambisonic coefficients 11B. By performing SVD with respect to the power spectral density (PSD) of the ambisonic coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the ambisonic coefficients.

The parameter calculation unit 32 represents a unit configured to calculate various parameters, such as a correlation parameter (R), directional properties parameters (θ, φ, r), and an energy property (e). Each of the parameters for the current frame may be denoted as R[k], θ[k], φ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], φ[k−1], r[k−1] and e[k−1], based on the previous frame of US[k−1] vector and V[k−1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the ambisonic coefficients 11B so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield (nBGa=(MinAmbHOAorder+1)$^2$), and indices (i) of additional BG ambisonic channels to send (which may collectively be denoted as background channel information 43 in the example of FIG. 2). The background channel information 42 may also be referred to as ambient channel information 43. Each of the channels that remains from numHOATransportChannels—nBGa, may either be an "additional background/ambient channel", an "active vector-based predominant channel", an "active directional based predominant signal" or "completely inactive". In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by (MinAmbHOAorder+1)$^2$+the number of times the index 10 (in the above example) appears as a channel type in the bitstream for that frame.

The soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of which of the possible ambisonic coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1, hence the audio encoding device may only need to indicate one of the additional ambient HOA coefficients having an index of 5-25. The information could thus be sent using a 5 bits syntax element (for $4^{th}$ order content), which may be denoted as "CodedAmbCoeffIdx." In any event, the soundfield analysis unit 44 outputs the background channel information 43 and the ambisonic coefficients 11B to the background (BG) selection unit 36, the background channel information 43 to coefficient reduction unit 46 and the bitstream generation unit 42, and the nFG 45 to a foreground selection unit 36.

The background selection unit 48 may represent a unit configured to determine background or ambient ambisonic coefficients 47 based on the background channel information (e.g., the background soundfield ($N_{BG}$) and the number (nBGa) and the indices (i) of additional BG ambisonic channels to send). For example, when $N_{BG}$ equals one, the background selection unit 48 may select the ambisonic coefficients 11B for each sample of the audio frame having an order equal to or less than one. The background selection unit 48 may, in this example, then select the ambisonic coefficients 11B having an index identified by one of the indices (i) as additional BG ambisonic coefficients, where the nBGa is provided to the bitstream generation unit 42 to be specified in the bitstream 21 so as to enable the audio decoding device, such as the audio decoding device 24 shown in the example of FIGS. 2 and 4, to parse the background ambisonic coefficients 47 from the bitstream 21. The background selection unit 48 may then output the ambient ambisonic coefficients 47 to the energy compensation unit 38. The ambient ambisonic coefficients 47 may have dimensions D: M×[($N_{BG}$+1)$^2$+nBGa]. The ambient ambisonic coefficients 47 may also be referred to as "ambient ambisonic coefficients 47," where each of the ambient ambisonic coefficients 47 corresponds to a separate ambient ambisonic channel 47 to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nfG}[k]$ 49, or $X_{PS}^{(1\ldots nFG)}(k)$ 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $51_k$ (which may be mathematically denoted as $\bar{V}_{1,\ldots,nFG}[k]$) having dimensions D: $(N+1)^2 \times$ nFG.

The energy compensation unit 38 may represent a unit configured to perform energy compensation with respect to the ambient ambisonic coefficients 47 to compensate for energy loss due to removal of various ones of the ambisonic channels by the background selection unit 48. The energy compensation unit 38 may perform an energy analysis with respect to one or more of the reordered US[k] matrix 33', the reordered V[k] matrix 35', the nFG signals 49, the foreground V[k] vectors $51_k$ and the ambient ambisonic coefficients 47 and then perform energy compensation based on the energy analysis to generate energy compensated ambient ambisonic coefficients 47'. The energy compensation unit 38 may output the energy compensated ambient coefficients 47' to the psychoacoustic audio coder unit 40.

The spatio-temporal interpolation unit 50 may represent a unit configured to receive the foreground V[k] vectors $51_k$ for the $k^{th}$ frame and the foreground V[k−1] vectors $51_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $51_k$ to recover reordered foreground ambisonic coefficients. The spatio-temporal interpolation unit 50 may then divide the reordered foreground ambisonic coefficients by the interpolated V[k] vectors to generate interpolated nFG signals 49'.

The spatio-temporal interpolation unit 50 may also output the foreground V[k] vectors $51_k$ that were used to generate the interpolated foreground V[k] vectors so that an audio decoding device, such as the audio decoding device 24, may generate the interpolated foreground V[k] vectors and thereby recover the foreground V[k] vectors $51_k$. The foreground V[k] vectors $51_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder. The spatio-temporal interpolation unit 50 may output the interpolated nFG signals 49' to the psychoacoustic audio coder unit 46 and the interpolated foreground V[k] vectors $51_k$ to the coefficient reduction unit 46.

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times$nFG. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information.

In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional ambisonic channels (which may be denoted by the variable TotalOfAddAmbHOAChan) from the set of $[(N_{BG}+1)^2+1, (N+1)^2]$.

The quantization unit 52 may represent a unit configured to perform any form of quantization to compress the reduced foreground V[k] vectors 55 to generate coded foreground V[k] vectors 57, outputting the coded foreground V[k] vectors 57 to the bitstream generation unit 42. In operation, the quantization unit 52 may represent a unit configured to compress a spatial component of the soundfield, i.e., one or more of the reduced foreground V[k] vectors 55 in this example. The quantization unit 52 may perform any one of the following 12 quantization modes, as indicated by a quantization mode syntax element denoted "NbitsQ":

| NbitsQ value | Type of Quantization Mode |
|---|---|
| 0-3: | Reserved |
| 4: | Vector Quantization |
| 5: | Scalar Quantization without Huffman Coding |
| 6: | 6-bit Scalar Quantization with Huffman Coding |
| 7: | 7-bit Scalar Quantization with Huffman Coding |
| 8: | 8-bit Scalar Quantization with Huffman Coding |
| . . . | . . . |
| 16: | 16-bit Scalar Quantization with Huffman Coding |

The quantization unit 52 may also perform predicted versions of any of the foregoing types of quantization modes, where a difference is determined between an element of (or a weight when vector quantization is performed) of the V-vector of a previous frame and the element (or weight when vector quantization is performed) of the V-vector of a current frame is determined. The quantization unit 52 may then quantize the difference between the elements or weights of the current frame and previous frame rather than the value of the element of the V-vector of the current frame itself.

The quantization unit 52 may perform multiple forms of quantization with respect to each of the reduced foreground V[k] vectors 55 to obtain multiple coded versions of the reduced foreground V[k] vectors 55. The quantization unit 52 may select the one of the coded versions of the reduced foreground V[k] vectors 55 as the coded foreground V[k] vector 57. The quantization unit 52 may, in other words, select one of the non-predicted vector-quantized V-vector, predicted vector-quantized V-vector, the non-Huffman-coded scalar-quantized V-vector, and the Huffman-coded scalar-quantized V-vector to use as the output switched-quantized V-vector based on any combination of the criteria discussed in this disclosure.

In some examples, the quantization unit 52 may select a quantization mode from a set of quantization modes that includes a vector quantization mode and one or more scalar quantization modes, and quantize an input V-vector based on (or according to) the selected mode. The quantization unit 52 may then provide the selected one of the non-predicted vector-quantized V-vector (e.g., in terms of weight values or bits indicative thereof), predicted vector-quantized V-vector (e.g., in terms of error values or bits indicative thereof), the non-Huffman-coded scalar-quantized V-vector and the Huffman-coded scalar-quantized V-vector to the bitstream generation unit 52 as the coded foreground V[k] vectors 57. The quantization unit 52 may also provide the syntax elements indicative of the quantization mode (e.g., the NbitsQ syntax element) and any other syntax elements used to dequantize or otherwise reconstruct the V-vector.

The psychoacoustic audio coder unit 40 included within the audio encoding device 20 may represent multiple instances of a psychoacoustic audio coder, each of which is used to encode a different audio object or ambisonic channel of each of the energy compensated ambient ambisonic coefficients 47' and the interpolated nFG signals 49' to generate encoded ambient ambisonic coefficients 59 and encoded nFG signals 61. The psychoacoustic audio coder unit 40 may output the encoded ambient ambisonic coefficients 59 and the encoded nFG signals 61 to the bitstream generation unit 42.

The bitstream generation unit 42 included within the audio encoding device 20 represents a unit that formats data to conform to a known format (which may refer to a format known by a decoding device), thereby generating the vector-based bitstream 21. The bitstream 21 may, in other words, represent encoded audio data, having been encoded in the manner described above.

The bitstream generation unit 42 may represent a multiplexer in some examples, which may receive the coded foreground V[k] vectors 57, the encoded ambient ambisonic coefficients 59, the encoded nFG signals 61 and the background channel information 43. The bitstream generation unit 42 may then generate a bitstream 21 based on the coded foreground V[k] vectors 57, the encoded ambient ambisonic coefficients 59, the encoded nFG signals 61 and the background channel information 43. In this way, the bitstream generation unit 42 may thereby specify the vectors 57 in the bitstream 21 to obtain the bitstream 21. The bitstream 21 may include a primary or main bitstream and one or more side channel bitstreams.

Various aspects of the techniques may also enable the bitstream generation unit 42 to, as described above, specify the audio rendering information 2 in or in parallel with the bitstream 21. While the current version of the upcoming 3D audio compression working draft, provides for signaling specific downmix matrices within the bitstream 21, the working draft does not provide for specifying of renderers used in rendering the object-based audio data 11A or the ambisonic coefficients 11B in the bitstream 21. For AMBISONIC content, the equivalent of such downmix matrix is the rendering matrix which converts the ambisonic representation into the desired loudspeaker feeds. For audio data in the object domain, the equivalent is a rendering matrix that is applied using matrix multiplication to render the object-based audio data into loudspeaker feeds.

Various aspects of the techniques described in this disclosure propose to further harmonize the feature sets of channel content and ambisonic coefficients by allowing the bitstream generation unit 46 to signal renderer selection information (e.g., ambisonic versus object-based renderer selection), renderer identification information (e.g., an entry in a codebook accessible to both the audio encoding device 20 and the audio decoding device 24), and/or the rendering matrices themselves within the bitstream 21 or side channel/metadata thereof (as, for example, the audio rendering information 2).

The audio encoding device 20 may include combined or discrete processing hardware configured to perform one or both (as the case may be) of the ambisonic or object-based encoding functionalities described above, as well as the renderer selection and signaling-based techniques of this disclosure. The processing hardware that the audio encoding device 20 includes for performing one or more of the ambisonic encoding, object-based encoding, and renderer-based techniques may include as one or more processors. These processor(s) of the audio encoding device 20 may include processing circuitry (e.g. fixed function circuitry, programmable processing circuitry, or any combination thereof), application specific integrated circuits (ASICs), such as one or more hardware ASICs, digital signal processors (DSPs), general purpose microprocessors, field programmable logic arrays (FPGAs), or other equivalent integrated circuitry or discrete logic circuitry for one or more ambisonic encoding, object-based audio encoding, and/or renderer selection and/or signaling based techniques. These processor(s) of the audio encoding device 20 may be configured to execute, using the processing hardware thereof, software to perform the functionalities described above.

Table 1 below is a syntax table providing details of example data that the audio encoding device 20 may signal to the audio decoding device 24 to provide the renderer information 2. Comment statements, which are bookended by "/*" and "*/" tags in Table 1, provide descriptive information of the corresponding syntax positioned adjacently thereto.

TABLE 1

Syntax of OBJrendering( )

| Syntax | No. of bits | Mnemonic |
|---|---|---|
| OBJrendering( ) | | |
| { | | |
| RendererFlag_ENTIRE_SEPARATE; | 1 | uimsbf |
| If (RendererFlag_ENTIRE_SEPARATE) { | | |
| /* for entire objects */ | | |
| RendererFlag_OBJ_HOA; | 1 | uimsbf |
| RendererFlag_External_Internal; | 1 | uimsbf |
| RendererFlag_Transmitted_Reference; | 1 | |
| If (RendererFlag_OBJ_HOA) { | | |
| /* OBJ renderer is used */ | | |
| If (RendererFlag_External_Internal) { | | |
| /* external renderer is used */ | | |
| } else { | | |
| /* internal renderer is used */ | | uimsbf |
| rendererID; | 5 | |
| If (RendererFlag_Transmitted_Reference) { | | |
| /* transmitted renderer is used */ | | |
| } else { | | |

TABLE 1-continued

Syntax of OBJrendering( )

| Syntax | No. of bits | Mnemonic |
|---|---|---|
| /* stored reference renderer is used */ | | |
| } | | |
| } | | |
| } else { | | |
| /* (1) OBJ audio+metadata is converted into HOA */ | | |
| OBJ2HOA_conversion( ); | | |
| /* (2) HOA renderer is used */ | | |
| If (RendererFlag_External_Internal) { | | |
| /* external renderer is used */ | | |
| } else { | | |
| /* internal renderer is used */ | | uimsbf |
| rendererID; | 5 | |
| If (RendererFlag_Transmitted_Reference) { | | |
| /* transmitted renderer is used */ | | |
| } else { | | |
| /* stored refernce renderer is used */ | | |
| } | | |
| } | | |
| } | | |
| } else { | | |
| /* for each object */ | | |
| for (i=0; i<numOBJ; i++) { | | uimsbf |
| RendererFlag_OBJ_HOA; | 1 | uimsbf |
| RendererFlag_External_Internal; | 1 | |
| RendererFlag_Transmitted_Reference; | 1 | |
| If (RendererFlag_OBJ_HOA) { | | |
| /* OBJ renderer is used */ | | |
| If (RendererFlag_External_Internal) { | | |
| /* external renderer is used */ | | |
| } else { | | uimsbf |
| /* internal renderer is used */ | | |
| rendererID; | 5 | |
| If (RendererFlag_Transmitted_Reference) { | | |
| /* transmitted renderer is used */ | | |
| } else { | | |
| /* stored refernce renderer is used */ | | |
| } | | |
| } | | |
| } else { | | |
| /* (1) OBJ audio+metadata is converted into HOA */ | | |
| OBJ2HOA_conversion( ); | | |
| /* (2) HOA renderer is used */ | | |
| If (RendererFlag_External_Internal) { | | |
| /* external renderer is used */ | | |
| } else { | | uimsbf |
| /* internal renderer is used */ | | |
| rendererID; | 5 | |
| If (RendererFlag_Transmitted_Reference) { | | |
| /* transmitted renderer is used */ | | |
| } else { | | |
| /* stored refernce renderer is used */ | | |
| } | | |
| } | | |
| } | | |
| } | | |
| } | | |
| } | | |

The semantics of Table 1 are described below:

a. RendererFlag_OBJ_HOA: To guarantee artistic intent of content producer, bit-stream syntax includes a bit-field saying that whether OBJ renderer (1) or ambisonic renderer shall be used (0).

b. RendererFlag_ENTIRE_SEPARATE: If 1, all the objects shall be rendered based on the RendererFlag_OBJ_HOA. If 0, each object shall be rendered based on the RendererFlag_OBJ_HOA.

c. RendererFlag_External_Internal: If 1, an external renderer can be used (if external renderer is not available, a reference renderer with ID 0 shall be used). If 0, an internal renderer shall be used.

d. RendererFlag_Transmitted_Reference: If 1, one of the transmitted renderer(s) shall be used. If 0, one of the reference renderer(s) shall be used.

e. rendererID: It indicates the renderer ID.

Table 2 below is a syntax table providing details of another example of data that the audio encoding device 20 may signal to the audio decoding device 24 to provide the renderer information 2, in accordance with "soft" rendering aspects of this disclosure. As in the case of Table 1 above, comment statements, which are bookended by "/*" and "*/" tags in Table 2 provide descriptive information of the corresponding syntax positioned adjacently thereto.

TABLE 2

Syntax of SoftOBJrendering( )

| Syntax | No. of bits | Mnemonic |
|---|---|---|
| SoftOBJrendering( ) | | |
| { | | |
| RendererFlag_ENTIRE_SEPARATE; | 1 | uimsbf |
| If (RendererFlag_ENTIRE_SEPARATE) { | | |
| /* for entire objects */ | | |
| alpha = SoftRendererParameter_OBJ_HOA/31; | 5 | uimsbf |
| RendererFlag_External_Internal; | 1 | uimsbf |
| RendererFlag_Transmitted_Reference; | 1 | |
| If (alpha ==1.0) { | | |
| /* OBJ renderer is used */ | | |
| If (RendererFlag_External_Internal) { | | |
| /* external renderer is used */ | | |
| } else { | | |
| /* internal renderer is used */ | | uimsbf |
| rendererID; | 5 | |
| If (RendererFlag_Transmitted_Reference) { | | |
| /* transmitted renderer is used */ | | |
| } else { | | |
| /* stored refernce renderer is used */ | | |
| } | | |
| } | | |
| } elseif (alpha == 0.0) { | | |
| /* (1) OBJ audio+metadata is converted into HOA */ | | |
| OBJ2HOA_conversion( ); | | |
| /* (2) HOA renderer is used */ | | |
| If (RendererFlag_External_Internal) { | | |
| /* external renderer is used */ | | |
| } else { | | |
| /* internal renderer is used */ | | uimsbf |
| rendererID; | 5 | |
| If (RendererFlag_Transmitted_Reference) { | | |
| /* transmitted renderer is used */ | | |
| } else { | | |
| /* stored reference renderer is used */ | | |
| } | | |
| } | | |
| } else { | | |
| /* do the both rendering and interpolation between them */ | | |
| } | | |
| } else { | | |
| /* for each object */ | | |
| for (i=0; i<numOBJ; i++) { | | uimsbf |
| alpha = SoftRendererParameter_OBJ_HOA/31; | 5 | uimsbf |
| RendererFlag_External_Internal; | 1 | |
| RendererFlag_Transmitted_Reference; | 1 | |
| If (alpha==1.0) { | | |
| /* OBJ renderer is used */ | | |
| If (RendererFlag_External_Internal) { | | |
| /* external renderer is used */ | | |
| } else { | | uimsbf |
| /* internal renderer is used */ | | |
| rendererID; | 5 | |
| If (RendererFlag_Transmitted_Reference) { | | |
| /* transmitted renderer is used */ | | |
| } else { | | |
| /* stored refernce renderer is used */ | | |
| } | | |
| } | | |
| } elseif (alpha==0.0) { | | |
| /* (1) OBJ audio+metadata is converted into HOA */ | | |
| OBJ2HOA_conversion( ); | | |
| /* (2) HOA renderer is used */ | | |
| If (RendererFlag_External_Internal) { | | |
| /* external renderer is used */ | | |
| } else { | | uimsbf |
| /* internal renderer is used */ | | |
| rendererID; | 5 | |
| If (RendererFlag_Transmitted_Reference) { | | |
| /* transmitted renderer is used */ | | |
| } else { | | |
| /* stored refernce renderer is used */ | | |
| } | | |
| } | | |
| } else { | | |

TABLE 2-continued

| Syntax of SoftOBJrendering( ) | |
|---|---|
| Syntax | No. of bits Mnemonic |
| /* do the both rendering and interpolation between them */ | |
| } | |
| } | |
| } | |
| } | |

The semantics of Table 2 are described below:

a. SoftRendererParameter_OBJ_HOA: To guarantee artistic intent of content producer, bit-stream syntax includes a bit-field for the soft rendering parameter between OBJ and ambisonic renderers.

b. RendererFlag_ENTIRE_SEPARATE: If 1, all the objects shall be rendered based on RendererFlag_OBJ_HOA. If 0, each object shall be rendered based on RendererFlag_OBJ_HOA.

c. RendererFlag_External_Internal: If 1, external renderer can be used (if external renderer is not available, a reference renderer with ID 0 shall be used). If 0, an internal renderer shall be used.

d. RendererFlag_Transmitted_Reference: If 1, one of the transmitted renderer(s) shall be used. If 0, one of the reference renderer(s) shall be used.

e. rendererID: It indicates the renderer ID.

f. alpha: soft rendering parameter (between 0.0 and 1.0)

Renderer output=alpha*object renderer output+(1-alpha)*ambisonic renderer output The bitstream generation unit 42 of the audio encoding device 20 may provide the data represented in the bitstream 21 to an interface 73, which in turn may signal the data in the form of the bitstream 21 to an external device. The interface 73 may include, be, or be part of various types of communication hardware, such as a network interface card (e.g., an Ethernet card), an optical transceiver, a radio frequency transceiver, or any other type of device that can receive (and potentially send) information. Other examples of such network interfaces that may be represented by the interface 73 include Bluetooth®, 3G, 4G, 5G, and WiFi® radios. The interface 73 may also be implemented according to any version of the Universal Serial Bus (USB) standards. As such, the interface 73 enables the audio encoding device 20 to communicate wirelessly, or using wired connection, or a combination thereof, with external devices, such as network devices. As such, the audio encoding device 20 may implement various techniques of this disclosure to provide renderer-related information to the audio decoding device 24 in or along with the bitstream 21. Further details on how the audio decoding device 24 may use the render-related information received in or along with the bitstream 21 are described below with respect to FIG. 3.

Figure 4:
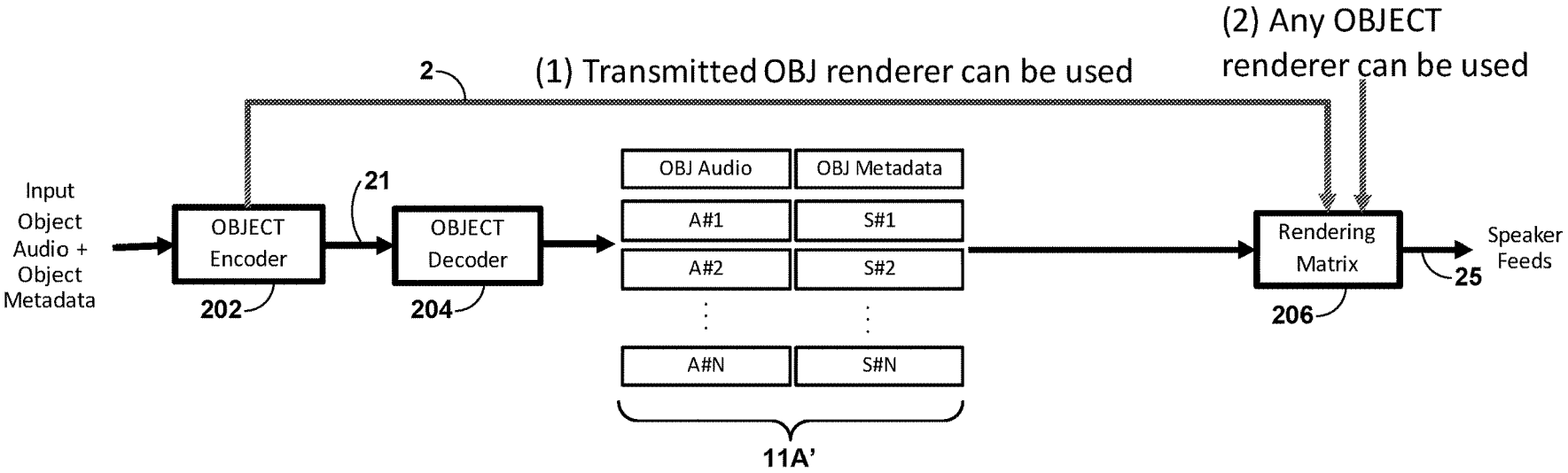
FIG. 4 is a diagram illustrating an example of a conventional workflow with respect to object-domain audio data.

FIG. 3 is a block diagram illustrating the audio decoding device 24 of FIG. 1 in more detail. As shown in the example of FIG. 4 the audio decoding device 24 may include an extraction unit 72, a renderer reconstruction unit 81, a directionality-based reconstruction unit 90 and a vector-based reconstruction unit 92. Although described below, more information regarding the audio decoding device 24 and the various aspects of decompressing or otherwise decoding ambisonic coefficients is available in International Patent Application with Publication No. WO 2014/194099, entitled "INTERPOLATION FOR DECOMPOSED REPRESENTATIONS OF A SOUND FIELD," filed 29 May, 2014.

The audio decoding device 24 is illustrated in FIG. 3 as including various units, each of which is further described below with respect to particular functionalities of the audio decoding device 24 as a whole. The various units of the audio decoding device 24 may be implemented using processor hardware, such as one or more processors. That is, a given processor of the audio decoding device 24 may implement the functionalities described below with respect to one of the illustrated units, or of multiple units of the illustrated units. The processor(s) of the audio decoding device 24 may include processing circuitry (e.g. fixed function circuitry, programmable processing circuitry, or any combination thereof), application specific integrated circuits (ASICs), such as one or more hardware ASICs, digital signal processors (DSPs), general purpose microprocessors, field programmable logic arrays (FPGAs), or other equivalent integrated circuitry or discrete logic circuitry. The processor(s) of the audio decoding device 24 may be configured to execute, using the processing hardware thereof, software to perform the functionalities described below with respect to the illustrated units.

The audio decoding device 24 includes an interface 91, which is configured to receive the bitstream 21 and relay the data thereof to the extraction unit 72. The interface 91 may include, be, or be part of various types of communication hardware, such as a network interface card (e.g., an Ethernet card), an optical transceiver, a radio frequency transceiver, or any other type of device that can receive (and potentially send) information. Other examples of such network interfaces that may be represented by the interface 91 include Bluetooth®, 3G, 4G, 5G, and WiFi® radios. The interface 91 may also be implemented according to any version of the Universal Serial Bus (USB) standards. As such, the interface 91 enables the audio decoding device 24 to communicate wirelessly, or using wired connection, or a combination thereof, with external devices, such as network devices.

The extraction unit 72 may represent a unit configured to receive the bitstream 21 and extract the audio rendering information 2 and the various encoded versions (e.g., a directional-based encoded version or a vector-based encoded version) of the object-based audio data 11A and/or ambisonic coefficients 11B. According to various examples of the techniques of this disclosure, the extraction unit 72 may obtain, from the audio rendering information 2, one or more of an indication of whether to use an ambisonic or an object-domain renderer of the audio renderers 22, a renderer ID of a particular renderer to be used (in the event that the audio renderers 22 include multiple ambisonic renderers or multiple object-based renderers), or the rendering matrix/matrices to be added to the audio renderers 22 for use in rendering the audio data 11 of the bitstream 21. For instance, in the renderer transmission based implementations of this disclosure, ambisonic and/or object-domain rendering matrices may be transmitted by the audio encoding device 20 to enable control over the rendering process at the audio playback system 16.

In the case of ambisonic rendering matrices, transmission may be facilitated by means of the mpegh3daConfigExtension of Type ID_CONFIG_EXT_HOA_MATRIX shown above. The mpegh3daConfigExtension may contain several ambisonic rendering matrices for different loudspeaker reproduction configurations. When ambisonic rendering matrices are transmitted, the audio encoding device 20 signals, for each ambisonic rendering matrix signal, the associated target loudspeaker layout that determines together with the HoaOrder the dimensions of the rendering matrix. When object-based rendering matrices are transmitted, the audio encoding device 20 signals, for each object-based rendering matrix signal, the associated target loudspeaker layout that determines the dimensions of the rendering matrix.

The transmission of a unique HoaRenderingMatrixId allows referencing to a default ambisonic rendering matrix available at the audio playback system 16, or to a transmitted ambisonic rendering matrix from outside of the audio bitstream 21. In some instances, every ambisonic rendering matrix is assumed to be normalized in N3D and follows the ordering of the ambisonic coefficients as defined in the bitstream 21. In instances in which the audio decoding device 24 receives a renderer ID in the bitstream 21, the audio decoding device 24 may compare the received renderer ID to entries of a codebook. Upon detecting a match in the codebook, the audio decoding device 24 may select the matched audio renderer 22 for rendering the audio data 11 (whether in the object domain or in the ambisonic domain, as the case may be).

Again, as described above, various aspects of the techniques may also enable the extraction unit 72 to parse the audio rendering information 2 from data the bitstream 21 of or side channel information signaled in parallel with the bitstream 21. While the current version of the upcoming 3D audio compression working draft, provides for signaling specific downmix matrices within the bitstream 21, the working draft does not provide for specifying of renderers used in rendering the object-based audio data 11A or the ambisonic coefficients 11B in the bitstream 21. For ambisonic content, the equivalent of such a downmix matrix is the rendering matrix which converts the ambisonic representation into the desired loudspeaker feeds. For audio data in the object domain, the equivalent is a rendering matrix that is applied using matrix multiplication to render the object-based audio data into loudspeaker feeds.

The audio decoding device 24 may include combined or discrete processing hardware configured to perform one or both (as the case may be) of the ambisonic or object-based decoding functionalities described above, as well as the renderer selection-based techniques of this disclosure. The processing hardware that the audio decoding device 24 includes for performing one or more of the ambisonic decoding, object-based decoding, and renderer-based techniques may include as one or more processors. These processor(s) of the audio decoding device 24 may include processing circuitry (e.g. fixed function circuitry, programmable processing circuitry, or any combination thereof), application specific integrated circuits (ASICs), such as one or more hardware ASICs, digital signal processors (DSPs), general purpose microprocessors, field programmable logic arrays (FPGAs), or other equivalent integrated circuitry or discrete logic circuitry for one or more ambisonic decoding, object-based audio decoding, and/or renderer selection techniques. These processor(s) of the audio decoding device 24 may be configured to execute, using the processing hardware thereof, software to perform the functionalities described above.

Various aspects of the techniques described in this disclosure propose to further harmonize the feature sets of channel content and ambisonic by allowing the audio decoding device 24 to obtain, in the form of the audio rendering information 2 renderer selection information (e.g., ambisonic versus object-based renderer selection), renderer identification information (e.g., an entry in a codebook accessible to both the audio encoding device 20 and the audio decoding device 24), and/or the rendering matrices themselves from the bitstream 21 itself or from side channel/metadata thereof.

As discussed above with respect to the semantics of Table 1, in one example, the audio decoding device 24 may receive one or more of the following syntax elements in the bitstream 21: a RendererFlag_OBJ_HOA flag, a RendererFlag_Transmitted_Reference flag, or RendererFlag_ENTIRE_SEPARATE flag, a RendererFlag_External_Internal, or a rendererID syntax element. The audio decoding device 24 may leverage the value of the RendererFlag_OBJ_HOA flag to preserve the artistic intent of the content producer. That is, if the value of the RendererFlag_OBJ_HOA flag is 1, then the audio decoding device 24 may select an object-based renderer (OBJ renderer) from the audio renderers 22 for rendering the corresponding portion of the audio data 11' obtained from the bitstream 21. Conversely, if the audio decoding device 24 determines that that the value of the RendererFlag_OBJ_HOA flag is 0, then the audio decoding device 24 may select an ambisonic renderer) from the audio renderers 22 for rendering the corresponding portion of the audio data 11' obtained from the bitstream 21.

The audio decoding device 24 may use the value of the RendererFlag_ENTIRE_SEPARATE flag to determine the level at which the value of the RendererFlag_OBJ_HOA is applicable. For instance, if the audio decoding device 24 determines that the value of the RendererFlag_ENTIRE_SEPARATE flag is 1, then the audio decoding device 24 may render all of the audio objects of the bitstream 21 based on the value of a single instance of the RendererFlag_OBJ_HOA flag. Conversely, if the audio decoding device 24 determines that the value of the RendererFlag_ENTIRE_SEPARATE flag is 0, then the audio decoding device 24 may render each audio object of the bitstream 21 individually based on the value of a respective corresponding instance of the RendererFlag_OBJ_HOA flag.

Additionally, the audio decoding device 24 may use the value of the RendererFlag_External_Internal flag to determine whether an external renderer or an internal renderer of the audio renderers 22 is to be used for rendering the corresponding portions of the bitstream 21. If the RendererFlag_External_Internal flag is set to a value of 1, the audio decoding device 24 may use an external renderer for rendering the corresponding audio data of the bitstream 21, provided that the external renderer is available. If the RendererFlag_External_Internal flag is set to the value of 1 and the audio decoding device 24 determines that the external renderer is not available, the audio decoding device may use a reference renderer with ID 0 (as a default option) to render the corresponding audio data of the bitstream 21. If the RendererFlag_External_Internal flag is set to a value of 0, then the audio decoding device 24 may use an internal renderer of the audio renderers 22 to render the corresponding audio data of the bitstream 21.

According to renderer transmission implementations of the techniques of this disclosure, the audio decoding device 24 may use the value of the RendererFlag_Transmitted_Reference flag to determine whether to use a renderer (e.g., a rendering matrix) explicitly signaled in the bitstream 21 for rendering the corresponding audio data, or to bypass any explicitly-rendered renderer and instead use a reference renderer to render the corresponding audio data of the bitstream 21. If the audio decoding device 24 determines that the value of the RendererFlag_Transmitted_Reference flag is 1, then the audio decoding device 24 may determine that one of the transmitted renderer(s) is to be used to render the corresponding audio data of the bitstream 21. Conversely, if the audio decoding device 24 determines that the value of the RendererFlag_Transmitted_Reference flag is 0, then the audio decoding device 24 may determine that one of the reference renderer(s) of the audio renderers 22 is to be used for rendering the corresponding audio data of the bitstream 21.

In some examples, if the audio encoding device 20 determines that the audio renderers 22 accessible to the audio decoding device 24 might include multiple renderers of the same type (e.g., multiple ambisonic renderers or multiple object-based renderers), the audio encoding device may signal a rendererID syntax element in the bitstream 21. In turn, the audio decoding device 24 may compare the value of the received rendererID syntax element to entries in a codebook. Upon detecting a match between the value of the received rendererID syntax element to a particular entry in the codebook, the audio decoding device 24: It indicates the renderer ID.

This disclosure also includes various "soft" rendering techniques. The syntax for various soft rendering techniques of this disclosure is given in Table 2 above. In accordance with the soft rendering techniques of this disclosure, the audio decoding device may parse a SoftRendererParameter_OBJ_HOA bit-field from the bitstream 21. The audio decoding device 24 may preserve the artistic intent of content producer based on the value(s) parsed from the bitstream 21 for the SoftRendererParameter_OBJ_HOA bit-field. For instance, according to the soft rendering techniques of this disclosure, the audio decoding device 24 may output a weighted combination of rendered object-domain audio data and rendered ambisonic-domain audio data.

In accordance with the soft rendering techniques of this disclosure, the audio decoding device 24 may use the RendererFlag_ENTIRE_SEPARATE flag, the RendererFlag_OBJ_HOA flag, the RendererFlag_External_Internal flag, the RendererFlag_Transmitted_Reference flag, and the rendererID syntax element in a manner similar to that described above with respect to other implementations of the renderer-selection techniques of this disclosure. In accordance with the soft rendering techniques of this disclosure, the audio decoding device 24 may additionally parse an alpha syntax element to obtain a soft rendering parameter value. The value of the alpha syntax element may be set between a lower bound (floor) of 0.0 and an upper bound (ceiling) of 1.0. To implement the soft rendering techniques of this disclosure, the audio decoding device may perform the following operation to obtain the rendering output:

alpha*object renderer output+(1-alpha)*ambisonic renderer output

FIG. 4 is a diagram illustrating an example of a workflow with respect to object-domain audio data. Additional details on conventional object-based audio data processing can be found in ISO/IEC FDIS 23008-3:2018(E), Information technology—High efficiency coding and media delivery in heterogeneous environments—Part 3: 3D audio.

As shown in the example of FIG. 4, an object encoder 202, which may represent another example of the audio encoding device 20 shown in the example of FIG. 1) may perform object encoding (e.g., according to the MPEG-H 3D Audio encoding standard referenced directly above) with respect to input object audio and object metadata (which is another way to refer to object-domain audio data) to obtain the bitstream 21. The object encoder 202 may also output the renderer information 2 for an object renderer.

An object decoder 204 (which may represent another example of the audio decoding device 24) may then perform audio decoding (e.g., according to the MPEG-H 3D Audio encoding standard referenced above) with respect to the bitstream 21 to obtain object-based audio data 11A'. The object decoder 204 may output the object-based audio data 11A' to a rendering matrix 206, which may represent an example of the audio renderers 22 shown in the example of FIG. 1. The audio playback system 16 may apply select the rendering matrix 206 based on the rendering information 2 or from among any object renderer. In any event, the rendering matrix 206 may output, based on the object-based audio data 11A', the speaker feeds 25.

Figure 5:
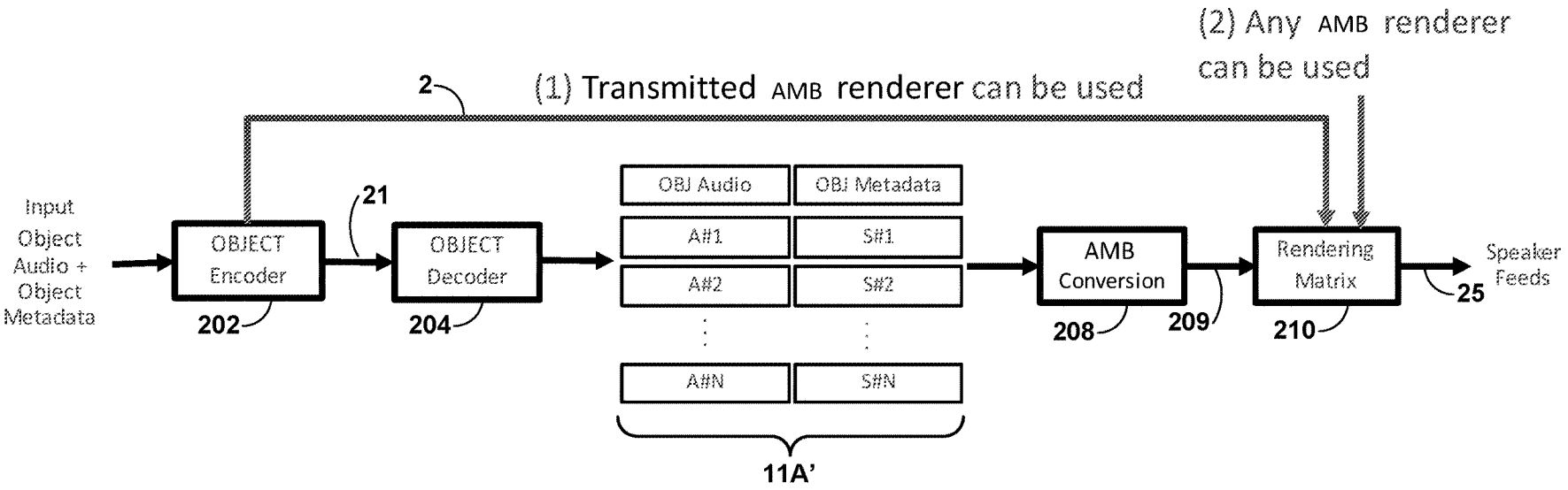
FIG. 5 is a diagram illustrating an example of a conventional workflow in which object-domain audio data is converted to the ambisonic domain and rendered using ambisonic renderer(s).

FIG. 5 is a diagram illustrating an example of a workflow in which object-domain audio data is converted to the ambisonic domain and rendered using ambisonic renderer(s). That is, the audio playback system 16 invokes an ambisonic conversion unit 208 to convert the object-based audio data 11A' from the spatial domain to the spherical harmonic domain and thereby obtain ambisonic coefficients 209 (and possibly HOA coefficient 209). The audio playback system 16 may then select rendering matrix 210, which is configured to render ambisonic audio data, including the ambisonic coefficients 209, to obtain speaker feeds 25.

To render an object-based input with ambisonic renderer(s) (such as a first order ambisonic renderer or a higher order ambisonic renderer), an audio rendering device may apply the following steps:

a. Converting the OBJECT input to an N-th order ambisonic, H:

$$H=\Sigma_{m=1}^{M}\alpha(r_m)A_m(t-\tau_m)Y(\theta_m, \varphi_m)$$

where M, $\alpha(r_m)$, $A_m(t)$, and $\tau_m$ are the number of objects, the m-th gain factor at the listener position given the object distance $r_m$, the m-th audio signal vector, and the delay for the m-th audio signal at the listener position, respectively. The gain $\alpha(r_m)$ can become extremely large when the distance between the audio object and listener position is small, hence a threshold for this gain is set. This gain is calculated using the Green's function for wave propagation. $Y(\theta, \varphi)=[Y_{00}(\theta, \varphi) \ldots Y_{NN}(\theta, \varphi)]^T$ is a vector of spherical harmonics with $Y_{nm}(\theta, \varphi)$ being a spherical harmonics of order n and suborder m. The azimuth and elevation angles for the m-th audio signal, $\theta_m$ and $\varphi_m$, are calculated at the listener position.

b. Rendering (binauralization) of the ambisonic signal, H, into a binaural audio output B:

$$B=R(H)$$

where R(·) is a binaural renderer.

Figure 6:
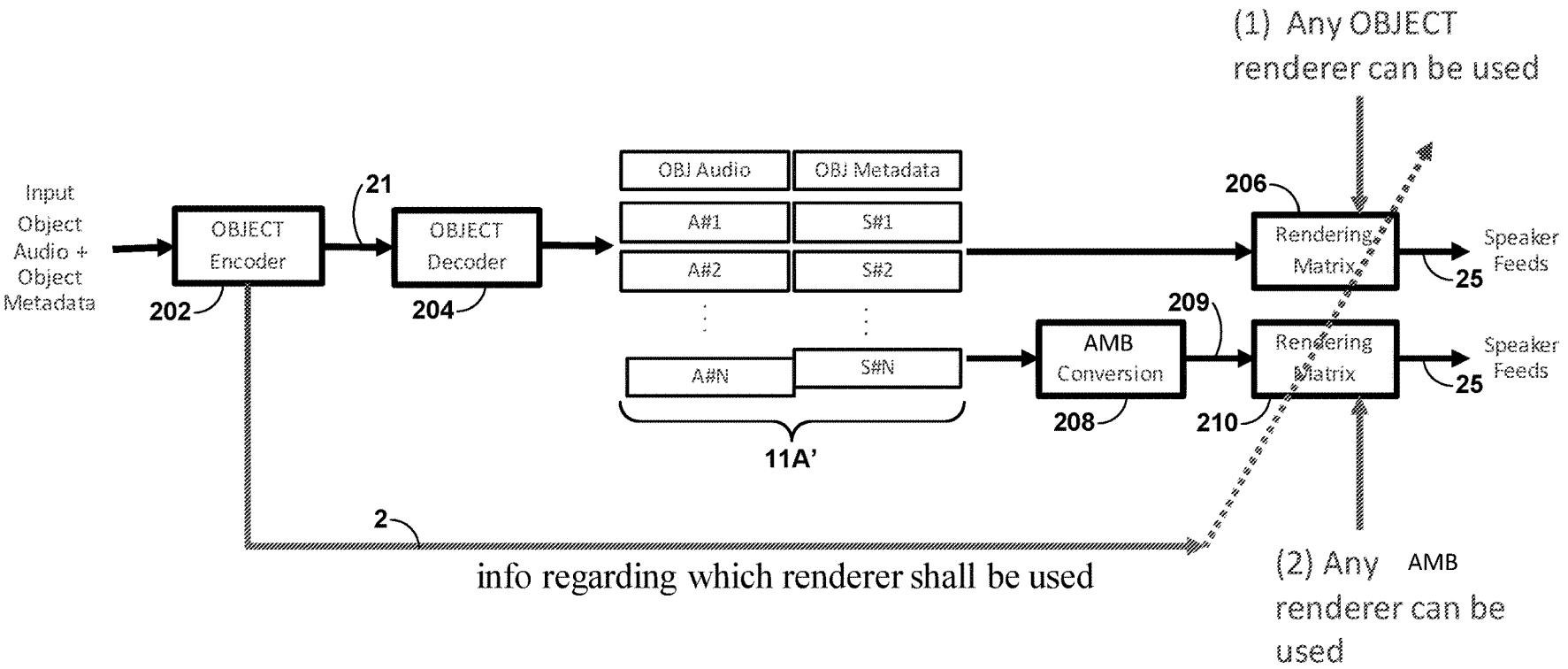
FIG. 6 is a diagram illustrating a workflow of this disclosure, according to which a renderer type is signaled from an audio encoding device to an audio decoding device.

FIG. 6 is a diagram illustrating a workflow of this disclosure, according to which a renderer type is signaled from the audio encoding device 202 to the audio decoding device 204. According to the workflow illustrated in FIG. 6, the audio encoding device 202 may transmit, to the audio decoding device 204, information regarding which type of renderer shall be used for rendering the audio data of the bitstream 21. According to the workflow illustrated in FIG. 6, the audio decoding device 24 may use the signaled information (stored as the audio rendering information 2) to select any object renderer or any ambisonic renderer available at the decoder end, e.g., a first order ambisonic renderer or a higher order ambisonic renderer. For instance, the workflow illustrated in FIG. 6 may use the RendererFlag_OBJ_HOA flag described above with respect to Tables 1 and 2.

Figure 7:
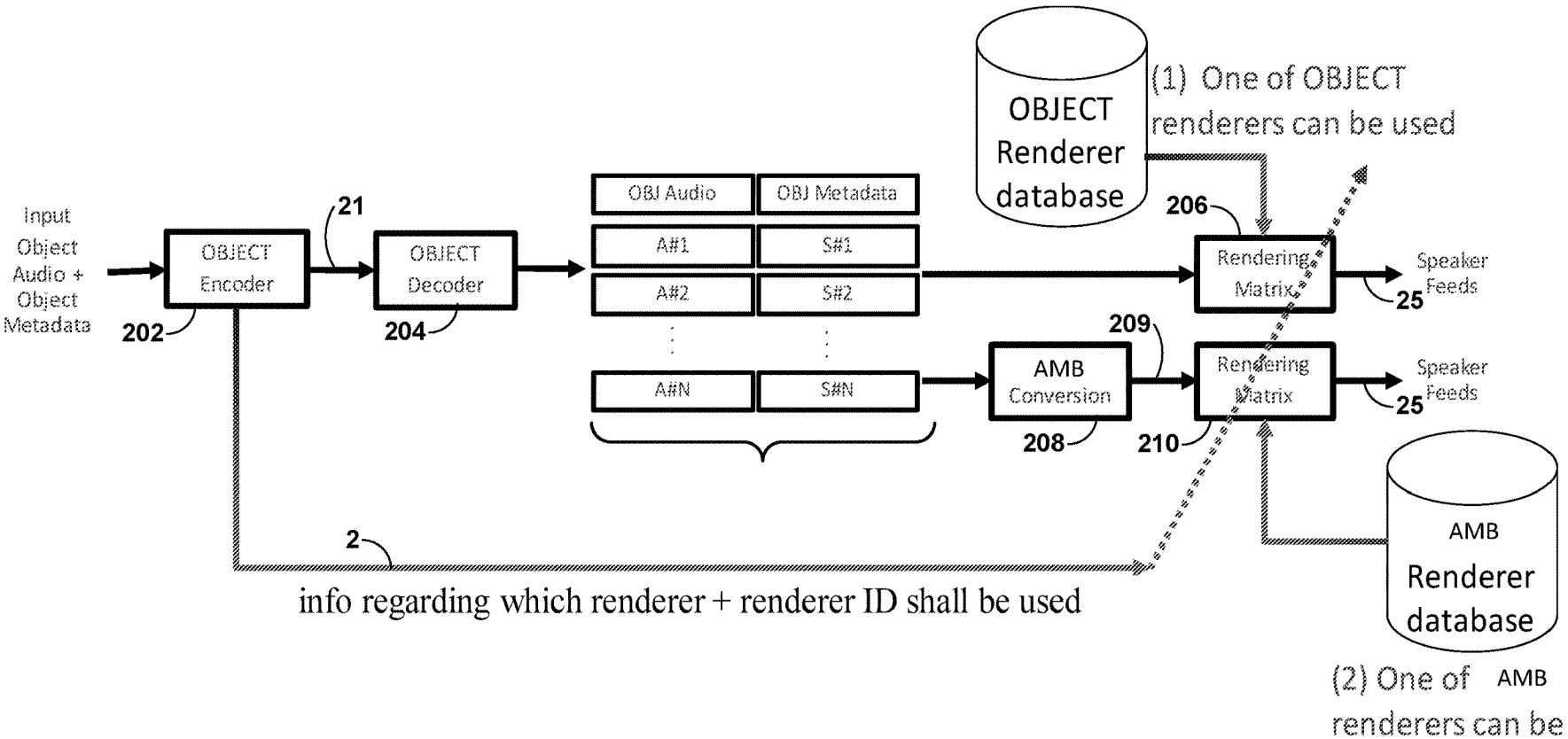
FIG. 7 is a diagram illustrating a workflow of this disclosure, according to which a renderer type and renderer identification information are signaled from an audio encoding device to an audio decoding device.

FIG. 7 is a is a diagram illustrating a workflow of this disclosure, according to which a renderer type and renderer identification information are signaled from the audio encoding device 202 to the audio decoding device 204. According to the workflow illustrated in FIG. 7, the audio encoding device 202 may transmit, to the audio decoding device 204, information 2 regarding the type of renderer as well as which specific renderer shall be used for rendering the audio data of the bitstream 21. According to the workflow illustrated in FIG. 7, the audio decoding device 204 may use the signaled information (stored as the audio rendering information 2) to select a particular object renderer or a particular ambisonic renderer available at the decoder end.

For instance, the workflow illustrated in FIG. 6 may use the RendererFlag_OBJ_HOA flag and the rendererID syntax element described above with respect to Tables 1 and 2. The workflow illustrated in FIG. 7 may be particularly useful in scenarios in which the audio renderers 22 include multiple ambisonic renderers and/or multiple object-based renderers to select from. For instance, the audio decoding device 204 may match the value of the rendererID syntax element to an entry in a codebook to determine which particular audio renderer 22 to use for rendering the audio data 11'.

Figure 8:
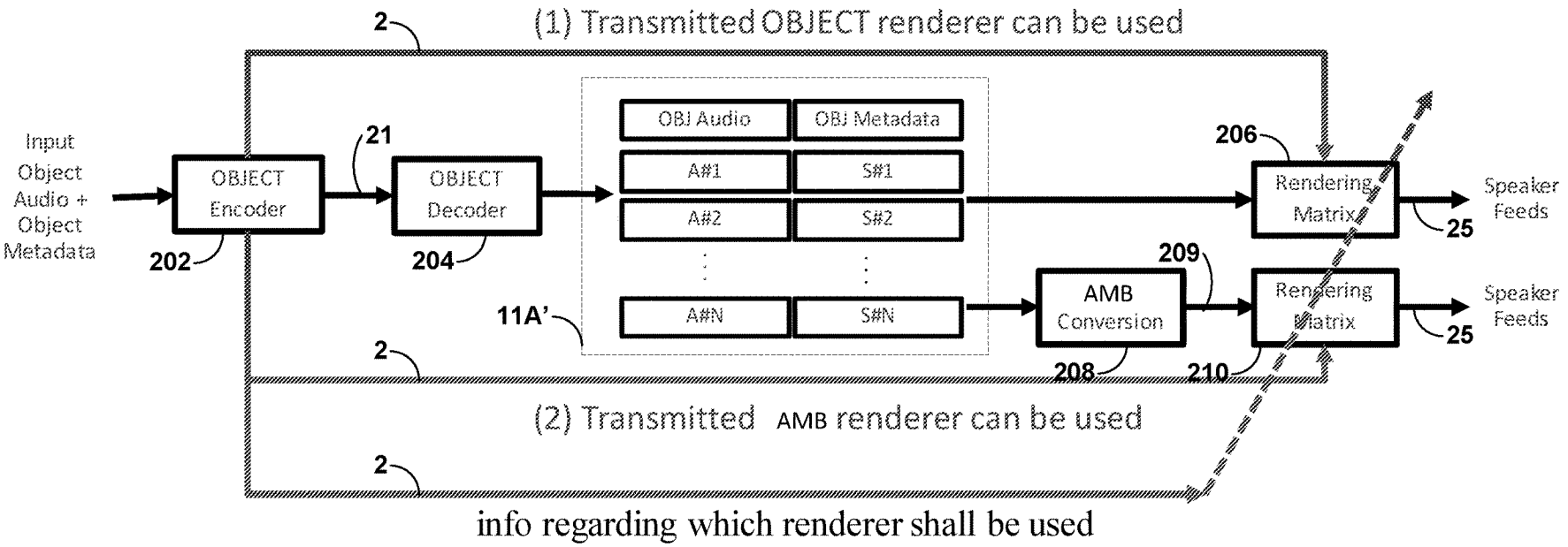
FIG. 8 is a diagram illustrating a workflow of this disclosure, according to the renderer transmission implementations of the techniques of this disclosure.

FIG. 8 is a is a diagram illustrating a workflow of this disclosure, according to the renderer transmission implementations of the techniques of this disclosure. According to the workflow illustrated in FIG. 8, the audio encoding device 202 may transmit, to the audio decoding device 204, information regarding the type of renderer as well as the rendering matrix itself (as rendering information 2) to be used for rendering the audio data of the bitstream 21. According to the workflow illustrated in FIG. 8, the audio decoding device 204 may use the signaled information (stored as the audio rendering information 2) to add, if necessary, the signaled rendering matrix to the audio renderers 22, and use the explicitly-signaled rendering matrix to render the audio data 11'.

Figure 9:
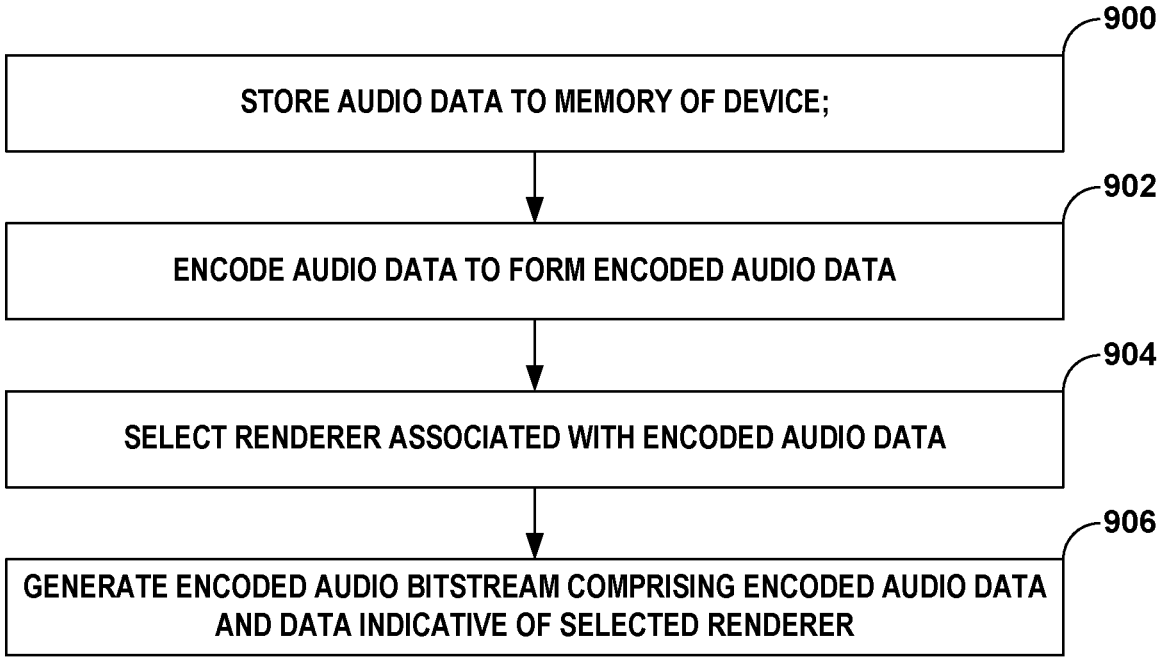
FIG. 9 is a flowchart illustrating example operation of the audio encoding device of FIG. 1 in performing example operation of the rendering techniques described in this disclosure.

FIG. 9 is a flowchart illustrating example operation of the audio encoding device of FIG. 1 in performing example operation of the rendering techniques described in this disclosure. The audio encoding device 20 may store audio data 11 to a memory of a device (900). Next, the audio encoding device 20 may encode the audio data 11 to form encoded audio data (which is shown as the bitstream 21 in the example of FIG. 1) (902). The audio encoding device 20 may select a renderer 1 associated with the encoded audio data 21 (904), where the selected renderer may include one of an object-based renderer or an ambisonic renderer. The audio encoding device 20 may then generate an encoded audio bitstream 21 comprising the encoded audio data and data indicative of the selected renderer (e.g., the rendering information 2) (906).

Figure 10:
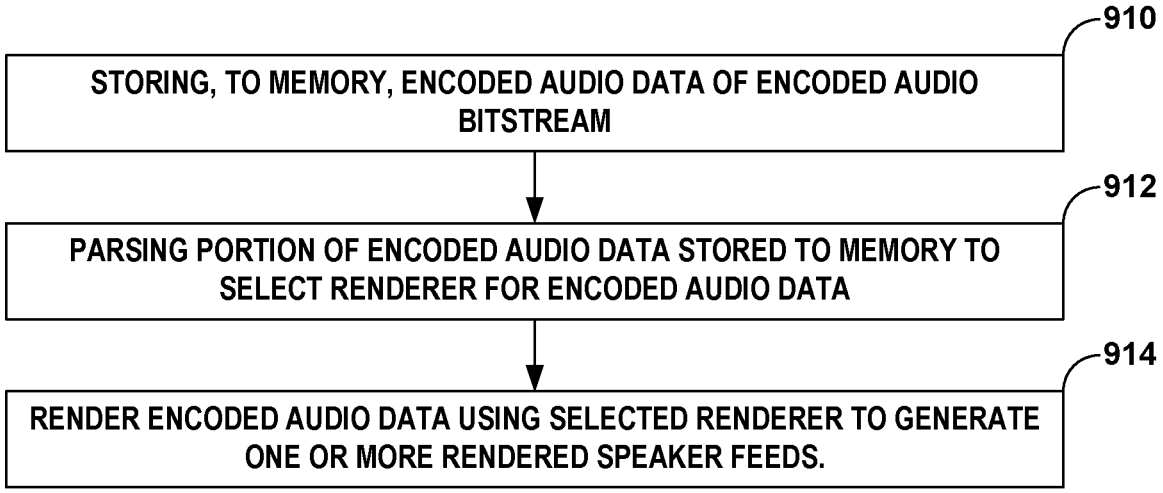
FIG. 10 is a flowchart illustrating example operation of the audio decoding device of FIG. 1 in performing example operation of the rendering techniques described in this disclosure.

FIG. 10 is a flowchart illustrating example operation of the audio decoding device of FIG. 1 in performing example operation of the rendering techniques described in this disclosure. The audio decoding device 24 may first store, to a memory of encoded audio data 11' of an encoded audio bitstream 21 (910). The audio decoding device 24 may then parse a portion of the encoded audio data stored to the memory to select a renderer for the encoded audio data 11' (912), where the selected renderer may include one of an object-based renderer or a ambisonic renderer. In this example it is assumed that the renderers 22 are incorporated within the audio decoding device 24. As such, the audio encoding device 24 may apply one or more renderers to the encoded audio data 11' to render the encoded audio data 11' using the selected renderer 22 to generate one or more rendered speaker feeds 25 (914).

Other examples of context in which the techniques may be performed include an audio ecosystem that may include acquisition elements, and playback elements. The acquisition elements may include wired and/or wireless acquisition devices (e.g., Eigen microphones or EigenMike® microphones), on-device surround sound capture, and mobile devices (e.g., smartphones and tablets). In some examples, wired and/or wireless acquisition devices may be coupled to mobile device via wired and/or wireless communication channel(s).

As such, in some examples, this disclosure is directed to a device for rendering audio data. The device includes a memory and one or more processors in communication with the memory. The memory is configured to store encoded audio data of an encoded audio bitstream. The one or more processors are configured to parse a portion of the encoded audio data stored to the memory to select a renderer for the encoded audio data, the selected renderer comprising one of an object-based renderer or a ambisonic renderer, and to render the encoded audio data using the selected renderer to generate one or more rendered speaker feeds. In some implementations, the device includes an interface in communication with the memory. In these implementations, the interface is configured to receive the encoded audio bitstream. In some implementations, the device includes one or more loudspeakers in communication with the one or more processors. In these implementations, the one or more loudspeakers are configured to output the one or more rendered speaker feeds.

In some examples, the one or more processors comprise processing circuitry. In some examples, the one or more processors comprise an application-specific integrated circuit (ASIC). In some examples, the one or more processors are further configured to parse metadata of the encoded audio data to select the renderer. In some examples, the one or more processors are further configured to select the renderer based on a value of a RendererFlag_OBJ_HOA flag included in the parsed portion of the encoded video data. In some examples, the one or more processors are configured to parse a RendererFlag_ENTIRE_SEPARATE flag, to determine, based on a value of the RendererFlag_ENTIRE_SEPARATE flag being equal to 1, that the value of the RendererFlag_OBJ_HOA applies to all objects of the encoded audio data rendered by the one or more processors, and to determine, based on a value of the RendererFlag_ENTIRE_SEPARATE flag being equal to 0, that the value of the RendererFlag_OBJ_HOA applies to only a single object of the encoded audio data rendered by the one or more processors.

In some examples, the one or more processors are further configured to obtain a rendering matrix from the parsed portion of the encoded audio data, the obtained rendering matrix representing the selected renderer. In some examples, the one or more processors are further configured to obtain a rendererID syntax element from the parsed portion of the encoded audio data. In some examples, the one or more processors are further configured to select the renderer by matching a value of the rendererID syntax element to an entry of multiple entries of a codebook. In some examples, the one or more processors are further configured to obtain a SoftRendererParameter_OBJ_HOA flag from the parsed portion of the encoded audio data, to determine, based on a value of the SoftRendererParameter_OBJ_HOA flag, that portions of the encoded audio data are to be rendered using the object-based renderer and the ambisonic renderer, and to generate the one or more rendered speaker feeds using a weighted combination of rendered object-domain audio data and rendered ambisonic-domain audio data obtained from the portions of the encoded audio data.

In some examples, the one or more processors are further configured to determine a weighting associated with the weighted combination based on a value of an alpha syntax element obtained from the parsed portion of the encoded video data. In some examples, the selected renderer is the ambisonic renderer, and the one or more processors are further configured to decode a portion of the encoded audio data stored to the memory to reconstruct decoded object-based audio data and object metadata associated with the decoded object-based audio data, to convert the decoded object-based audio and the object metadata into an ambisonic domain to form ambisonic-domain audio data, and to render the ambisonic-domain audio data using the ambisonic renderer to generate the one or more rendered speaker feeds.

In some examples, the one or more processors are configured to obtain a rendering matrix from the parsed portion of the encoded audio data, the obtained rendering matrix representing the selected renderer, to parse a RendererFlag_Transmitted_Reference flag, to use, based on a value of the RendererFlag_Transmitted_Reference flag being equal to 1, the obtained rendering matrix to render the encoded audio data, and to use, based on a value of the RendererFlag_Transmitted_Reference flag being equal to 0, a reference renderer to render the encoded audio data.

In some examples, the one or more processors are configured to obtain a rendering matrix from the parsed portion of the encoded audio data, the obtained rendering matrix representing the selected renderer, to parse a RendererFlag_External_Internal flag, to determine, based on a value of the RendererFlag_External_Internal flag being equal to 1, that the selected renderer is an external renderer, and to determine, based on the value of the RendererFlag_External_Internal flag being equal to 0, that the selected renderer is an external renderer. In some examples, the value of the RendererFlag_External_Internal flag is equal to 1, and the one or more processors are configured to determine that the external renderer is unavailable for rendering the encoded audio data, and to determine, based on the external renderer being unavailable for rendering the encoded audio data, that the selected renderer is a reference renderer.

As such, in some examples, this disclosure is directed to a device for encoding audio data. The device includes a memory, and one or more processors in communication with the memory. The memory is configured to store audio data. The one or more processors are configured to encode the audio data to form encoded audio data, to select a renderer associated with the encoded audio data, the selected renderer comprising one of an object-based renderer or a ambisonic renderer, and to generate an encoded audio bitstream comprising the encoded audio data and data indicative of the selected renderer. In some implementations, the device includes one or more microphones in communication with the memory. In these implementations, the one or more microphones are configured to receive the audio data. In some implementations, the device includes and interface in communication with the one or more processors. In these implementations, the interface is configured to signal the encoded audio bitstream.

In some examples, the one or more processors comprise processing circuitry. In some examples, the one or more processors comprise an application-specific integrated circuit (ASIC). In some examples, the one or more processors are further configured to include the data indicative of the selected renderer in metadata of the encoded audio data. In some examples, the one or more processors are further configured to include a RendererFlag_OBJ_HOA flag in the encoded audio bitstream, and wherein a value of a RendererFlag_OBJ_HOA flag is indicative of the selected renderer.

In some examples, the one or more processors are configured to set a value of a RendererFlag_ENTIRE_SEPARATE flag being equal to 1, based on a determination that the value of the RendererFlag_OBJ_HOA applies to all objects of the encoded audio bitstream, to set the value of the RendererFlag_ENTIRE_SEPARATE flag being equal to 0, based on a determination that the value of the RendererFlag_OBJ_HOA applies to only a single object of the encoded audio bitstream, and to include the RendererFlag_OBJ_HOA flag in the encoded audio bitstream. In some examples, the one or more processors are further configured to include a rendering matrix in the encoded audio bitstream, the rendering matrix representing the selected renderer.

In some examples, the one or more processors are further configured to include a rendererID syntax element in the encoded audio bitstream. In some examples, a value of the rendererID syntax element matches an entry of multiple entries of a codebook accessible to the one or more processors. In some examples, the one or more processors are further configured to determine that portions of the encoded audio data are to be rendered using the object-based renderer and the ambisonic renderer, and to include a SoftRendererParameter_OBJ_HOA flag in the encoded audio bitstream based on the determination that the portions of the encoded audio data are to be rendered using the object-based renderer and the ambisonic renderer.

In some examples, the one or more processors are further configured to determine a weighting associated with the SoftRendererParameter_OBJ_HOA flag; and include an alpha syntax element indicative of the weighting in the encoded audio bitstream. In some examples, the one or more processors are configured to include a RendererFlag_Transmitted_Reference flag in the encoded audio bitstream, and to include, based on a value of the RendererFlag_Transmitted_Reference flag being equal to 1, a rendering matrix in the encoded audio bitstream, the rendering matrix representing the selected renderer. In some examples, the one or more processors are configured to set a value of a RendererFlag_External_Internal flag equal to 1, based on a determination that the selected renderer is an external renderer, to set the value of the RendererFlag_External_Internal flag equal to 0, based on a determination that the selected renderer is an external renderer, and to include the RendererFlag_External_Internal flag in the encoded audio bitstream.

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the ambisonic coefficients for playback by one or more of the playback elements. For instance, a user of the mobile device may record (acquire a soundfield of) a live event (e.g., a meeting, a conference, a play, a concert, etc.), and code the recording into ambisonic coefficients.

The mobile device may also utilize one or more of the playback elements to playback the ambisonic coded soundfield. For instance, the mobile device may decode the ambisonic coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into ambisonic coefficients, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of ambisonic signals. For instance, the one or more DAWs may include ambisonic plugins and/or tools which may be configured to operate with (e.g., work with) one or more game audio systems. In some examples, the game studios may output new stem formats that support ambisonic. In any case, the game studios may output coded audio content to the rendering engines which may render a soundfield for playback by the delivery systems.

The techniques may also be performed with respect to exemplary audio acquisition devices. For example, the techniques may be performed with respect to an EigenMike® microphone which may include a plurality of microphones that are collectively configured to record a 3D soundfield. In some examples, the plurality of microphones of EigenMike® microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more EigenMike® microphones. The production truck may also include an audio encoder, such as the audio encoding device 20 of FIGS. 2 and 3.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as the audio encoding device 20 of FIGS. 2 and 3.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones or EigenMike® microphones may be placed in and/or around the baseball stadium), ambisonic coefficients corresponding to the 3D soundfield may be obtained and transmitted to a decoder, the decoder may reconstruct the 3D soundfield based on the ambisonic coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform. In some instances, the means may comprise processing circuitry (e.g., fixed function circuitry and/or programmable processing circuitry) and/or one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), processing circuitry (e.g. fixed function circuitry, programmable processing circuitry, or any combination thereof), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

The foregoing described techniques may enable the examples set for the following clauses:

Clause 1. A device for rendering audio data, the device comprising: a memory configured to store encoded audio data of an encoded audio bitstream; and one or more processors in communication with the memory, the one or more processors being configured to: parse a portion of the encoded audio data stored to the memory to select a renderer for the encoded audio data, the selected renderer comprising one of an object-based renderer or an ambisonics renderer; and render the encoded audio data using the selected renderer to generate one or more rendered speaker feeds.

Clause 1.1. The device of clause 1, further comprising an interface in communication with the memory, the interface being configured to receive the encoded audio bitstream.

Clause 1.2. The device of either clause 1 or 1.1, further comprising one or more loudspeakers in communication with the one or more processors, the one or more loudspeakers being configured to output the one or more rendered speaker feeds.

Clause 2. The device of any of clauses 1-1.2, wherein the one or more processors comprise processing circuitry.

Clause 3. The device of any of clauses 1-2, wherein the one or more processors comprise an application-specific integrated circuit (ASIC).

Clause 4. The device of any of clauses 1-3, wherein the one or more processors are further configured to parse metadata of the encoded audio data to select the renderer.

Clause 5. The device of any of clauses 1-4, wherein the one or more processors are further configured to select the renderer based on a value of a RendererFlag_OBJ_HOA flag included in the parsed portion of the encoded video data.

Clause 6. The device of clause 5, wherein the one or more processors are configured to: parse a RendererFlag_ENTIRE_SEPARATE flag; based on a value of the RendererFlag_ENTIRE_SEPARATE flag being equal to 1, determine that the value of the RendererFlag_OBJ_HOA applies to all objects of the encoded audio data rendered by the one or more processors; and based on a value of the RendererFlag_ENTIRE_SEPARATE flag being equal to 0, determine that the value of the RendererFlag_OBJ_HOA applies to only a single object of the encoded audio data rendered by the one or more processors.

Clause 7. The device of any of clauses 1-6, wherein the one or more processors are further configured to obtain a rendering matrix from the parsed portion of the encoded audio data, the obtained rendering matrix representing the selected renderer.

Clause 8. The device of any of clauses 1-6, wherein the one or more processors are further configured to obtain a rendererID syntax element from the parsed portion of the encoded audio data.

Clause 9. The device of clause 8, wherein the one or more processors are further configured to select the renderer by matching a value of the rendererID syntax element to an entry of multiple entries of a codebook.

Clause 10. The device of any of clauses 1-8, wherein the one or more processors are further configured to: obtain a SoftRendererParameter_OBJ_HOA flag from the parsed portion of the encoded audio data; determine, based on a value of the SoftRendererParameter_OBJ_HOA flag, that portions of the encoded audio data are to be rendered using the object-based renderer and the ambisonic renderer; and generate the one or more rendered speaker feeds using a weighted combination of rendered object-domain audio data and rendered ambisonic-domain audio data obtained from the portions of the encoded audio data.

Clause 11. The device of clause 10, wherein the one or more processors are further configured to determine a weighting associated with the weighted combination based on a value of an alpha syntax element obtained from the parsed portion of the encoded video data.

Clause 12. The device of any of clauses 1-11, wherein the selected renderer is the ambisonic renderer, and wherein the one or more processors are further configured to: decode a portion of the encoded audio data stored to the memory to reconstruct decoded object-based audio data and object metadata associated with the decoded object-based audio data; convert the decoded object-based audio and the object metadata into an ambisonic domain to form ambisonic-domain audio data; and render the ambisonic-domain audio data using the ambisonic renderer to generate the one or more rendered speaker feeds.

Clause 13. The device of any of clauses 1-12, wherein the one or more processors are configured to: obtain a rendering matrix from the parsed portion of the encoded audio data, the obtained rendering matrix representing the selected renderer; parse a RendererFlag_Transmitted_Reference flag; based on a value of the RendererFlag_Transmitted_Reference flag being equal to 1, use the obtained rendering matrix to render the encoded audio data; and based on a value of the RendererFlag_Transmitted_Reference flag being equal to 0, use a reference renderer to render the encoded audio data.

Clause 14. The device of any of clauses 1-13, wherein the one or more processors are configured to: obtain a rendering matrix from the parsed portion of the encoded audio data, the obtained rendering matrix representing the selected renderer; parse a RendererFlag_External_Internal flag; based on a value of the RendererFlag_External_Internal flag being equal to 1, determine that the selected renderer is an external renderer; and based on the value of the RendererFlag_External_Internal flag being equal to 0, determine that the selected renderer is an external renderer.

Clause 15. The device of clause 14, wherein the value of the RendererFlag_External_Internal flag is equal to 1, and wherein the one or more processors are configured to: determine that the external renderer is unavailable for rendering the encoded audio data; and based on the external renderer being unavailable for rendering the encoded audio data, determine that the selected renderer is a reference renderer.

Clause 16. A method of rendering audio data, the method comprising: storing, to a memory of the device, encoded audio data of an encoded audio bitstream; parsing, by one or more processors of the device, a portion of the encoded audio data stored to the memory to select a renderer for the encoded audio data, the selected renderer comprising one of an object-based renderer or an ambisonic renderer; and rendering, by the one or more processors of the device, the encoded audio data using the selected renderer to generate one or more rendered speaker feeds.

Clause 16.1. The method of clause 16, further comprising receiving, at an interface of a device, the encoded audio bitstream.

Clause 16.2. The method of either clause 16 or 16.1, further comprising outputting, by one or more loudspeakers of the device, the one or more rendered speaker feeds Clause 17. The method of any of clauses 16-16.2, further comprising parsing, by the one or more processors of the device, metadata of the encoded audio data to select the renderer.

Clause 18. The method of any of clauses 16-17, further comprising selecting, by the one or more processors of the device, the renderer based on a value of a RendererFlag_OBJ_HOA flag included in the parsed portion of the encoded video data.

Clause 19. The method of clause 18, further comprising: parsing, by the one or more processors of the device, a RendererFlag_ENTIRE_SEPARATE flag; based on a value of the RendererFlag_ENTIRE_SEPARATE flag being equal 1, determining, by the one or more processors of the device, that the value of the RendererFlag_OBJ_HOA applies to all objects of the encoded audio data rendered by the processing circuitry; and based on a value of the RendererFlag_ENTIRE_SEPARATE flag being equal to 0, determining, by the one or more processors of the device, that the value of the RendererFlag_OBJ_HOA applies to only a single object of the encoded audio data rendered by the processing circuitry.

Clause 20. The method of any of clauses 16-19, further comprising obtaining, by the one or more processors of the device, a rendering matrix from the parsed portion of the encoded audio data, the obtained rendering matrix representing the selected renderer.

Clause 21. The method of any of clauses 16-19, further comprising obtaining, by the one or more processors of the device, a rendererID syntax element from the parsed portion of the encoded audio data.

Clause 22. The method of clause 21, further comprising selecting, by the one or more processors of the device, the renderer by matching a value of the rendererID syntax element to an entry of multiple entries of a codebook.

Clause 23. The method of any of clauses 16-21, further comprising: obtaining, by the one or more processors of the device, a SoftRendererParameter_OBJ_HOA flag from the parsed portion of the encoded audio data; determining, by the one or more processors of the device, based on a value of the SoftRendererParameter_OBJ_HOA flag, that portions of the encoded audio data are to be rendered using the object-based renderer and the ambisonic renderer; and generating, by the one or more processors of the device, the one or more rendered speaker feeds using a weighted combination of rendered object-domain audio data and rendered ambisonic-domain audio data obtained from the portions of the encoded audio data.

Clause 24. The method of clause 23, further comprising determining, by the one or more processors of the device, a weighting associated with the weighted combination based on a value of an alpha syntax element obtained from the parsed portion of the encoded video data.

Clause 25. The method of any of clauses 16-24, wherein the selected renderer is the ambisonic renderer, the method further comprising: decoding, by the one or more processors of the device, a portion of the encoded audio data stored to the memory to reconstruct decoded object-based audio data and object metadata associated with the decoded object-based audio data; converting, by the one or more processors of the device, the decoded object-based audio and the object metadata into an ambisonic domain to form ambisonic-domain audio data; and rendering, by the one or more processors of the device, the ambisonic-domain audio data using the ambisonic renderer to generate the one or more rendered speaker feeds.

Clause 26. The method of any of clauses 16-25, further comprising: obtaining, by the one or more processors of the device, a rendering matrix from the parsed portion of the encoded audio data, the obtained rendering matrix representing the selected renderer; parsing, by the one or more processors of the device, a RendererFlag_Transmitted_Reference flag; based on a value of the RendererFlag_Transmitted_Reference flag being equal to 1, using, by the one or more processors of the device, the obtained rendering matrix to render the encoded audio data; and based on a value of the RendererFlag_Transmitted_Reference flag being equal to 0, using, by the one or more processors of the device, a reference renderer to render the encoded audio data.

Clause 27. The method of any of clauses 16-26, further comprising: obtaining, by the one or more processors of the device, a rendering matrix from the parsed portion of the encoded audio data, the obtained rendering matrix representing the selected renderer; parsing, by the one or more processors of the device, a RendererFlag_External_Internal flag; based on a value of the RendererFlag_External_Internal flag being equal to 1, determining, by the one or more processors of the device, that the selected renderer is an external renderer; and based on the value of the RendererFlag_External_Internal flag being equal to 0, determining, by the one or more processors of the device, that the selected renderer is an external renderer.

Clause 28. The method of clause 27, wherein the value of the RendererFlag_External_Internal flag is equal to 1, the method further comprising: determining, by the one or more processors of the device, that the external renderer is unavailable for rendering the encoded audio data; and based on the external renderer being unavailable for rendering the encoded audio data, determining, by the one or more processors of the device, that the selected renderer is a reference renderer.

Clause 29. An apparatus configured to render audio data, the apparatus comprising: means for storing encoded audio data of an encoded audio bitstream; means for parsing a portion of the stored encoded audio data to select a renderer for the encoded audio data, the selected renderer comprising one of an object-based renderer or an ambisonics renderer; and means for rendering the stored encoded audio data using the selected renderer to generate one or more rendered speaker feeds.

Clause 29.1. The apparatus of clause 29, further comprising means for receiving the encoded audio bitstream.

Clause 29.2. The apparatus of either clause 29 or clause 29.1, further comprisingmeans for outputting the one or more rendered speaker feeds.

Clause 30. A non-transitory computer-readable storage medium encoded with instructions that, when executed, cause one or more processors of a device for rendering audio data to: store, to a memory of the device, encoded audio data of an encoded audio bitstream; parse a portion of the encoded audio data stored to the memory to select a renderer for the encoded audio data, the selected renderer comprising one of an object-based renderer or an ambisonic renderer; and render the encoded audio data using the selected renderer to generate one or more rendered speaker feeds.

Clause 30.1. The non-transitory computer-readable medium of clause 30, further encoded with instructions that, when executed, cause the one or more processors to receive the encoded audio bitstream, via an interface of the device for rendering the audio data.

Clause 30.2. The non-transitory computer-readable medium of either clause 30 or clause 30.1, further encoded with instructions that, when executed, cause the one or more processors to output the one or more rendered speaker feeds via one or more loudspeakers of the device.

Clause 31. A device for encoding audio data, the device comprising: a memory configured to store the audio data; and one or more processors in communication with the memory, the one or more processors being configured to: encode the audio data to form encoded audio data; select a renderer associated with the encoded audio data, the selected renderer comprising one of an object-based renderer or an ambisonic renderer; and generate an encoded audio bitstream comprising the encoded audio data and data indicative of the selected renderer.

Clause 32. The device of clause 31, wherein the one or more processors comprise processing circuitry.

Clause 33. The device of either of clauses 31 or 32, wherein the one or more processors comprise an application-specific integrated circuit (ASIC).

Clause 34. The device of any of clauses 31-33, wherein the one or more processors are further configured to include the data indicative of the selected renderer in metadata of the encoded audio data.

Clause 35. The device of any of clauses 31-34, wherein the one or more processors are further configured to include a RendererFlag_OBJ_HOA flag in the encoded audio bitstream, and wherein a value of a RendererFlag_OBJ_HOA flag is indicative of the selected renderer.

Clause 36. The device of clause 35, wherein the one or more processors are configured to: set a value of a RendererFlag_ENTIRE_SEPARATE flag being equal to 1, based on a determination that the value of the RendererFlag_OBJ_HOA applies to all objects of the encoded audio bitstream; set the value of the RendererFlag_ENTIRE_SEPARATE flag being equal to 0, based on a determination that the value of the RendererFlag_OBJ_HOA applies to only a single object of the encoded audio bitstream; and include the RendererFlag_OBJ_HOA flag in the encoded audio bitstream.

Clause 37. The device of any of clauses 31-36, wherein the one or more processors are further configured to include a rendering matrix in the encoded audio bitstream, the rendering matrix representing the selected renderer.

Clause 38. The device of any of clauses 31-36, wherein the one or more processors are further configured to include a rendererID syntax element in the encoded audio bitstream.

Clause 39. The device of clause 38, wherein a value of the rendererID syntax element matches an entry of multiple entries of a codebook accessible to the one or more processors.

Clause 40. The device of any of clauses 31-39, wherein the one or more processors are further configured to: determine that portions of the encoded audio data are to be rendered using the object-based renderer and the ambisonic renderer; and include a SoftRendererParameter_OBJ_HOA flag in the encoded audio bitstream based on the determination that the portions of the encoded audio data are to be rendered using the object-based renderer and the ambisonic renderer.

Clause 41. The device of clause 40, wherein the one or more processors are further configured to determine a weighting associated with the SoftRendererParameter_OBJ_HOA flag; and include an alpha syntax element indicative of the weighting in the encoded audio bitstream.

Clause 42. The device of any of clauses 31-41, wherein the one or more processors are configured to: include a RendererFlag_Transmitted_Reference flag in the encoded audio bitstream; and based on a value of the RendererFlag_Transmitted_Reference flag being equal to 1, include a rendering matrix in the encoded audio bitstream, the rendering matrix representing the selected renderer.

Clause 43. The device of any of clauses 31-42, wherein the one or more processors are configured to: set a value of a RendererFlag_External_Internal flag equal to 1, based on a determination that the selected renderer is an external renderer; set the value of the RendererFlag_External_Internal flag equal to 0, based on a determination that the selected renderer is an external renderer; and include the RendererFlag_External_Internal flag in the encoded audio bitstream.

Clause 44. The device of any of clauses 31-43, further comprising one or more microphones in communication with the memory, the one or more microphones being configured to receive the audio data.

Clause 45. The device of any of clauses 31-44, further comprising an interface in communication with the one or more processors, the interface being configured to signal the encoded audio bitstream.

Clause 46. A method of encoding audio data, the method comprising: storing audio data to a memory of a device; encoding, by one or more processors of the device, the audio data to form encoded audio data; selecting, by the one or more processors of the device, a renderer associated with the encoded audio data, the selected renderer comprising one of an object-based renderer or an ambisonic renderer; and generating, by the one or more processors of the device, an encoded audio bitstream comprising the encoded audio data and data indicative of the selected renderer.

Clause 47. The method of clause 46, further comprising signaling, by an interface of the device, the encoded audio bitstream.

Clause 48. The method of either clause 46 or claim 47, further comprising receiving, by one or more microphones of the device, the audio data.

Clause 49. The method of any of clauses 46-48, further comprising including, by the one or more processors of the device, the data indicative of the selected renderer in metadata of the encoded audio data.

Clause 50. The method of any of clauses 46-49, further comprising including, by the one or more processors of the device, a RendererFlag_OBJ_HOA flag in the encoded audio bitstream, and wherein a value of a RendererFlag_OBJ_HOA flag is indicative of the selected renderer.

Clause 51. The method of clause 50, further comprising: setting, by the one or more processors of the device, a value of a RendererFlag_ENTIRE_SEPARATE flag being equal to 1, based on a determination that the value of the RendererFlag_OBJ_HOA applies to all objects of the encoded audio bitstream; setting, by the one or more processors of the device, the value of the RendererFlag_ENTIRE_SEPARATE flag being equal to 0, based on a determination that the value of the RendererFlag_OBJ_HOA applies to only a single object of the encoded audio bitstream; and including, by the one or more processors of the device, the RendererFlag_OBJ_HOA flag in the encoded audio bitstream.

Clause 52. The method of any of clauses 46-51, further comprising including, by the one or more processors of the device, a rendering matrix in the encoded audio bitstream, the rendering matrix representing the selected renderer.

Clause 53. The method of any of clauses 46-51, further comprising including, by the one or more processors of the device, a rendererID syntax element in the encoded audio bitstream.

Clause 54. The method of clause 53, wherein a value of the rendererID syntax element matches an entry of multiple entries of a codebook accessible to the one or more processors of the device.

Clause 55. The method of any of clauses 46-54, further comprising: determining, by the one or more processors of the device, that portions of the encoded audio data are to be rendered using the object-based renderer and the ambisonic renderer; and including, by the one or more processors of the device, a SoftRendererParameter_OBJ_HOA flag in the encoded audio bitstream based on the determination that the portions of the encoded audio data are to be rendered using the object-based renderer and the ambisonic renderer.

Clause 56. The method of clause 55, further comprising: determining, by the one or more processors of the device, a weighting associated with the SoftRendererParameter_OBJ_HOA flag; and including, by the one or more processors of the device, an alpha syntax element indicative of the weighting in the encoded audio bitstream.

Clause 57. The method of any of clauses 46-56, further comprising: including, by the one or more processors of the device, a RendererFlag_Transmitted_Reference flag in the encoded audio bitstream; and based on a value of the RendererFlag_Transmitted_Reference flag being equal to 1, including, by the one or more processors of the device, a rendering matrix in the encoded audio bitstream, the rendering matrix representing the selected renderer.

Clause 58. The method of any of clauses 46-57, further comprising: setting, by the one or more processors of the device, a value of a RendererFlag_External_Internal flag equal to 1, based on a determination that the selected renderer is an external renderer; setting, by the one or more processors of the device, the value of the RendererFlag_External_Internal flag equal to 0, based on a determination that the selected renderer is an external renderer; and including, by the one or more processors of the device, the RendererFlag_External_Internal flag in the encoded audio bitstream.

Clause 59. An apparatus for encoding audio data, the apparatus comprising: means for storing audio data; means for encoding the audio data to form encoded audio data; means for selecting a renderer associated with the encoded audio data, the selected renderer comprising one of an object-based renderer or an ambisonic renderer; and means for generating an encoded audio bitstream comprising the encoded audio data and data indicative of the selected renderer.

Clause 60. The apparatus of clause 59, further comprising means for signaling the encoded audio bitstream.

Clause 61. The apparatus of either clause 59 or claim 60, further comprising means for receiving the audio data.

Clause 62. A non-transitory computer-readable storage medium encoded with instructions that, when executed, cause one or more processors of a device for encoding audio data to: store audio data to a memory of the device; encode the audio data to form encoded audio data; select a renderer associated with the encoded audio data, the selected renderer comprising one of an object-based renderer or an ambisonic renderer; and generate an encoded audio bitstream comprising the encoded audio data and data indicative of the selected renderer.

Clause 63. The non-transitory computer-readable medium of clause 62, further encoded with instructions that, when executed, cause the one or more processors to signal the encoded audio bitstream via an interface of the device.

Clause 64. The non-transitory computer-readable medium of either claim 62 or clause 63, further encoded with instructions that, when executed, cause the one or more processors to receive the audio data via one or more microphones of the device.

Various aspects of the techniques have been described. These and other aspects of the techniques are within the scope of the following claims.

What is claimed is:

1. A device for rendering audio data, the device comprising:

a memory configured to store encoded audio data of an encoded audio bitstream; and one or more processors in communication with the memory, the one or more processors being configured to:

parse metadata of the encoded audio data stored to the memory that identifies which renderer to select for the encoded audio data as a selected renderer;

obtain a rendering matrix from the parsed metadata of the encoded audio data, the obtained rendering matrix representing the selected renderer, the selected renderer comprising one of an object-based renderer or an ambisonic renderer, the selected renderer having been used during production of at least a portion of the encoded audio data, and the parsed metadata identifying which renderer to select for the encoded audio data independently from a determined format of the encoded audio data; and render the encoded audio data using the selected renderer to generate one or more rendered speaker feeds.

2. The device of claim 1, further comprising an interface in communication with the memory, the interface being configured to receive the encoded audio bitstream.

3. The device of claim 1, further comprising one or more loudspeakers in communication with the one or more processors, the one or more loudspeakers being configured to output the one or more rendered speaker feeds.

4. The device of claim 1, wherein the one or more processors comprise processing circuitry.

5. The device of claim 1, wherein the one or more processors comprise an application-specific integrated circuit (ASIC).

6. The device of claim 1, wherein the one or more processors are further configured to select the selected renderer based on a value of a RendererFlag_OBJ_HOA flag included in the parsed metadata of the encoded video data.

7. The device of claim 6, wherein the one or more processors are configured to:

parse a RendererFlag_ENTIRE_SEPARATE flag;

based on a value of the RendererFlag_ENTIRE_SEPARATE flag being equal to 1, determine that the value of the RendererFlag_OBJ_HOA applies to all objects of the encoded audio data rendered by the one or more processors; and based on a value of the RendererFlag_ENTIRE_ SEPARATE flag being equal to 0, determine that the value of the RendererFlag_OBJ_HOA applies to only a single object of the encoded audio data rendered by the one or more processors.

8. The device of claim 1, wherein the one or more processors are further configured to obtain a rendererID syntax element from the parsed metadata of the encoded audio data.

9. The device of claim 8, wherein the one or more processors are further configured to select the renderer by matching a value of the rendererID syntax element to an entry of multiple entries of a codebook.

10. The device of claim 1, wherein the one or more processors are further configured to:

obtain a SoftRendererParameter_OBJ_HOA flag from the parsed portion of the encoded audio data;

determine, based on a value of the SoftRendererParameter_OBJ_HOA flag, that portions of the encoded audio data are to be rendered using the object-based renderer and the ambisonic renderer; and generate the one or more rendered speaker feeds using a weighted combination of rendered object-domain audio data and rendered ambisonic-domain audio data obtained from the portions of the encoded audio data.

11. The device of claim 10, wherein the one or more processors are further configured to determine a weighting associated with the weighted combination based on a value of an alpha syntax element obtained from the parsed portion of the encoded video data.

12. The device of claim 1, wherein the selected renderer is the ambisonic renderer, and wherein the one or more processors are further configured to:

decode a portion of the encoded audio data stored to the memory to reconstruct decoded object-based audio data and object metadata associated with the decoded object-based audio data;

convert the decoded object-based audio and the object metadata into an ambisonic domain to form ambisonic-domain audio data; and render the ambisonic-domain audio data using the ambisonic renderer to generate the one or more rendered speaker feeds.

13. The device of claim 1, wherein the one or more processors are configured to:

parse a RendererFlag_Transmitted_ Reference flag;

based on a value of the RendererFlag_Transmitted_Reference flag being equal to 1, use the obtained rendering matrix to render the encoded audio data; and based on a value of the RendererFlag_Transmitted_Reference flag being equal to 0, use a reference renderer to render the encoded audio data.

14. The device of claim 1, wherein the one or more processors are configured to:

parse a RendererFlag_External_Internal flag;

based on a value of the RendererFlag_External_Internal flag being equal to 1, determine that the selected renderer is an external renderer; and based on the value of the RendererFlag_External_Internal flag being equal to 0, determine that the selected renderer is an internal renderer.

15. The device of claim 14, wherein the value of the RendererFlag_External_Internal flag is equal to 1, and wherein the one or more processors are configured to:

determine that the external renderer is unavailable for rendering the encoded audio data; and based on the external renderer being unavailable for rendering the encoded audio data, determine that the selected renderer is a reference renderer.

16. The device of claim 1, wherein the ambisonic renderer includes a higher order ambisonic renderer.

17. A method of rendering audio data, the method comprising:

storing, to a memory of the device, encoded audio data of an encoded audio bitstream;

parsing, by one or more processors of the device, metadata of the encoded audio data stored to the memory that identifies which renderer to select for the encoded audio data as a selected renderer;

obtaining, by the one or more processors, a rendering matrix from the parsed metadata of the encoded audio data, the obtained rendering matrix representing the selected renderer, the selected renderer comprising one of an object-based renderer or an ambisonic renderer, the selected renderer having been used during production of at least a portion of the encoded audio data, and the parsed metadata identifying which renderer to select for the encoded audio data independently from a determined format of the encoded audio data; and rendering, by the one or more processors of the device, the encoded audio data using the selected renderer to generate one or more rendered speaker feeds.

18. The method of claim 17, further comprising receiving, at an interface of a device, the encoded audio bitstream.

19. The method of claim 17, further comprising outputting, by one or more loudspeakers of the device, the one or more rendered speaker feeds.

20. The method of claim 17, further comprising selecting, by the one or more processors of the device, the renderer based on a value of a RendererFlag_OBJ_HOA flag included in the parsed metadata of the encoded video data.

21. The method of claim 17, further comprising:

parsing, by the one or more processors of the device, a RendererFlag_ENTIRE_SEPARATE flag;

based on a value of the RendererFlag_ENTIRE_SEPARATE flag being equal 1, determining, by the one or more processors of the device, that the value of the RendererFlag_OBJ_HOA applies to all objects of the encoded audio data rendered by the processing circuitry; and based on a value of the RendererFlag ENTIRE SEPARATE flag being equal to 0, determining, by the one or more processors of the device, that the value of the RendererFlag_OBJ_HOA applies to only a single object of the encoded audio data rendered by the processing circuitry.

22. The method of claim 17, further comprising obtaining, by the one or more processors of the device, a rendererID syntax element from the parsed metadata of the encoded audio data.

23. The method of claim 22, further comprising selecting, by the one or more processors of the device, the renderer by matching a value of the rendererID syntax element to an entry of multiple entries of a codebook.

24. The method of claim 17, further comprising:

parsing, by the one or more processors of the device, a RendererFlag_External_Internal flag;

based on a value of the RendererFlag_External_Internal flag being equal to 1:

determining, by the one or more processors of the device, that the external renderer is unavailable for rendering the encoded audio data; and based on the external renderer being unavailable for rendering the encoded audio data, determining, by the one or more processors of the device, that the selected renderer is a reference renderer.

25. An apparatus configured to render audio data, the apparatus comprising:

means for storing encoded audio data of an encoded audio bitstream;

means for parsing a portion of the stored encoded audio data that identifies which renderer to select for the encoded audio data as the selected renderer;

means for obtaining a rendering matrix from the parsed metadata of the encoded audio data, the obtained rendering matrix representing the selected renderer, the selected renderer comprising one of an object-based renderer or an ambisonic renderer, the selected renderer having been used during production of at least a portion of the encoded audio data, and the parsed metadata identifying which renderer to select for the encoded audio data independently from a determined format of the encoded audio data; and means for rendering the stored encoded audio data using the selected renderer to generate one or more rendered speaker feeds.

26. A non-transitory computer-readable storage medium encoded with instructions that, when executed, cause one or more processors of a device for rendering audio data to:

store, to a memory of the device, encoded audio data of an encoded audio bitstream;

parse a portion of the encoded audio data stored to the memory that identifies which renderer to select for the encoded audio data as a selected renderer;

obtain a rendering matrix from the parsed metadata of the encoded audio data, the obtained rendering matrix representing the selected renderer, the selected renderer comprising one of an object-based renderer or an ambisonic renderer, the selected renderer having been used during production of at least a portion of the encoded audio data, and the parsed metadata identifying which renderer to select for the encoded audio data independently from a determined format of the encoded audio data; and render the encoded audio data using the selected renderer to generate one or more rendered speaker feeds.

* * * * *